US010658746B2

(12) United States Patent
Koshi et al.

(10) Patent No.: US 10,658,746 B2
(45) Date of Patent: May 19, 2020

(54) WIRELESS MODULE AND IMAGE DISPLAY DEVICE

(71) Applicant: Panasonic Intellectual Property Management Co., Ltd., Osaka (JP)

(72) Inventors: Masashi Koshi, Ishikawa (JP); Hitoshi Takai, Osaka (JP); Kazuhiro Imai, Osaka (JP); Hiroyuki Uno, Ishikawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 15 days.

(21) Appl. No.: 16/083,310

(22) PCT Filed: Feb. 15, 2017

(86) PCT No.: PCT/JP2017/005482
§ 371 (c)(1),
(2) Date: Sep. 7, 2018

(87) PCT Pub. No.: WO2017/159184
PCT Pub. Date: Sep. 21, 2017

(65) Prior Publication Data

US 2019/0089046 A1 Mar. 21, 2019

(30) Foreign Application Priority Data

Mar. 17, 2016 (JP) ..... 2016-053977

(51) Int. Cl.
*H01Q 1/52* (2006.01)
*H01Q 1/48* (2006.01)
(Continued)

(52) U.S. Cl.
CPC ..... *H01Q 1/523* (2013.01); *H01Q 1/2291* (2013.01); *H01Q 1/38* (2013.01); *H01Q 1/48* (2013.01);
(Continued)

(58) Field of Classification Search
CPC ..... H01Q 1/523; H01Q 1/48; H01Q 1/2291; H01Q 5/30; H01Q 9/0421
See application file for complete search history.

(56) References Cited

U.S. PATENT DOCUMENTS 5,231,407 A * 7/1993 McGirr ..... H01Q 1/243 343/700 MS
2013/0069836 A1 3/2013 Bungo
2013/0234896 A1 9/2013 Sharawi et al.

FOREIGN PATENT DOCUMENTS

EP 2662926 A2 11/2013
EP 2996193 A1 3/2016
(Continued)

OTHER PUBLICATIONS

International Search Report of PCT application No. PCT/JP2017/005482 dated May 16, 2017.
(Continued)

*Primary Examiner* — Hoang V Nguyen
(74) *Attorney, Agent, or Firm* — McDermott Will & Emery LLP

(57) ABSTRACT

A wireless module includes a substrate, a ground pattern disposed on the substrate, a first antenna, a second antenna, and a base plate that is conductive. The first antenna is disposed between one end of the substrate and the ground pattern, and includes a grounding part and a first power feeding part, the grounding part is connected to the ground pattern, and the first power feeding part is fed with a first signal. The second antenna is disposed between the other end of the substrate and the ground pattern, and includes a
(Continued)

second power feeding part fed with a second signal. The base plate includes a first opposed portion that faces the first antenna, a second opposed portion that faces the second antenna, and a third opposed portion that faces the ground pattern and is short-circuited to the ground pattern. The base plate also has, on the third opposed portion, a short-circuit point at which the base plate and the ground pattern are short-circuited to each other. The short-circuit point is disposed on the third opposed portion at a position nearer to the first opposed portion than to the second opposed portion.

17 Claims, 23 Drawing Sheets

(51) Int. Cl.

| | |
|---|---|
| ***H01Q 21/28*** | (2006.01) |
| ***H01Q 9/04*** | (2006.01) |
| ***H01Q 5/30*** | (2015.01) |
| ***H01Q 1/22*** | (2006.01) |
| ***H01Q 1/38*** | (2006.01) |
| *H01Q 1/24* | (2006.01) |

(52) U.S. Cl.

CPC ..... *H01Q 1/521* (2013.01); *H01Q 5/30* (2015.01); *H01Q 9/0407* (2013.01); *H01Q 9/0421* (2013.01); *H01Q 21/28* (2013.01); *H01Q 1/243* (2013.01)

(56) References Cited

FOREIGN PATENT DOCUMENTS

| | | |
|---|---|---|
| JP | 2013-070365 | 4/2013 |
| WO | 1990/013152 A1 | 11/1990 |

OTHER PUBLICATIONS

The Extended European Search Report dated Feb. 20, 2019 for the related European Patent Application No. 17766191.5.

* cited by examiner

WIRELESS MODULE AND IMAGE DISPLAY DEVICE

CROSS-REFERENCE TO RELATED APPLICATIONS

This application is a U.S. national stage application of the PCT International Application No. PCT/JP2017/005482 filed on Feb. 15, 2017, which claims the benefit of foreign priority of Japanese patent application No. 2016-053977 filed on Mar. 17, 2016, the contents all of which are incorporated herein by reference.

TECHNICAL FIELD

The present disclosure relates to a wireless module including an antenna, and to an image display device including the wireless module.

BACKGROUND ART

PTL 1 discloses a wireless communication device including a plurality of antennas. In the wireless communication device disclosed in PTL 1, two conductor plates are disposed between two antennas, and a slit is formed by providing short-circuit members at two locations between the two conductor plates. The wireless communication device disclosed in PTL 1 is configured such that the slit has a function equivalent to a slit antenna to improve isolation between two antennas.

CITATION LIST

Patent Literature

PTL 1: Unexamined Japanese Patent Publication No. 2013-70365

SUMMARY

The present disclosure provides: a wireless module that includes two antennas, can enhance isolation between two antennas, and can expand a frequency band in which isolation can be ensured; and an image display device including the wireless module.

This wireless module in the present disclosure includes a substrate, a ground pattern disposed on the substrate, a first antenna, a second antenna, and a base plate that is conductive. The first antenna is disposed between one end of the substrate and the ground pattern, and includes a grounding part and a first power feeding part, the grounding part is connected to the ground pattern, and the first power feeding part is fed with a first signal. The second antenna is disposed between the other end of the substrate and the ground pattern, and includes a second power feeding part fed with a second signal. The base plate includes a first opposed portion that faces the first antenna, a second opposed portion that faces the second antenna, and a third opposed portion that faces the ground pattern and is short-circuited to the ground pattern. The base plate also has, on the third opposed portion, a short-circuit point at which the base plate and the ground pattern are short-circuited to each other. The short-circuit point is disposed on the third opposed portion at a position nearer to the first opposed portion than to the second opposed portion.

The wireless module according to the present disclosure can enhance isolation between two antennas and is effective for expanding a frequency band in which isolation can be ensured.

DESCRIPTION OF EMBODIMENTS

Exemplary embodiments will be described in detail below with reference to the drawings as appropriate. However, detailed descriptions that are more than necessary may be omitted. For example, a detailed description of a matter that has been already well-known, or an overlapped description for a substantially identical configuration may be omitted. This is intended to avoid unnecessary redundancy of the following description and to facilitate understanding by those skilled in the art.

Note that the attached drawings and the following description are provided for those skilled in the art to fully understand the present disclosure, and are not intended to limit the subject matter as described in the appended claims.

It should also be noted that each of the diagrams is schematic, and is not necessarily strictly accurate. Further, in the respective drawings, substantially identical components are denoted by identical reference marks, and descriptions of those components may be omitted or simplified.

First Exemplary Embodiment

Hereinafter, a wireless module according to a first exemplary embodiment will be described with reference to FIGS. 1A to 2.

[1-1. Configuration]

First, a configuration of wireless module 1 in this exemplary embodiment will be described with reference to the drawings.

Figure 1A:
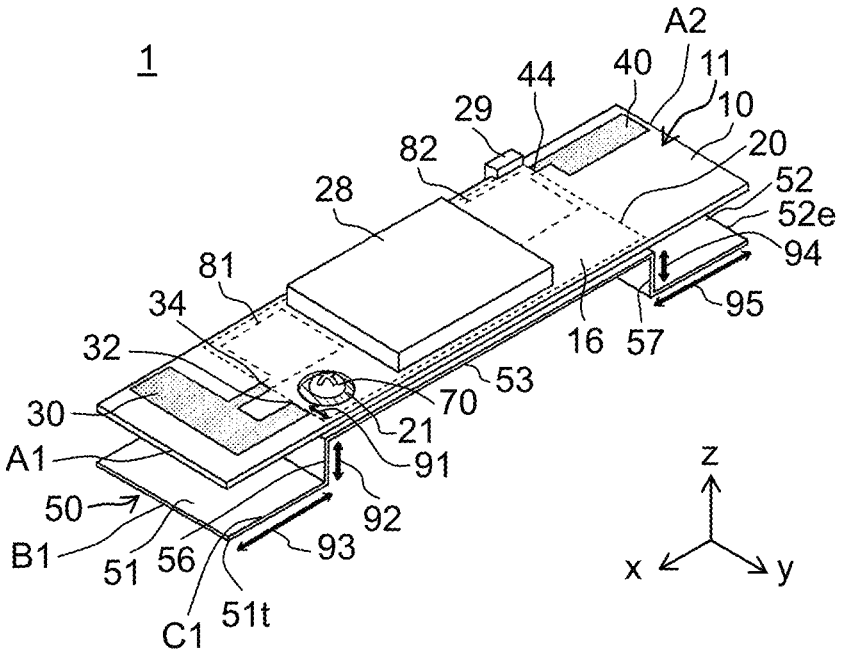
FIG. 1A is a perspective view schematically showing an example of an external appearance of a wireless module in a first exemplary embodiment.

FIG. 1A is a perspective view schematically showing an example of an external appearance of wireless module 1 in the first exemplary embodiment.

Figure 1B:
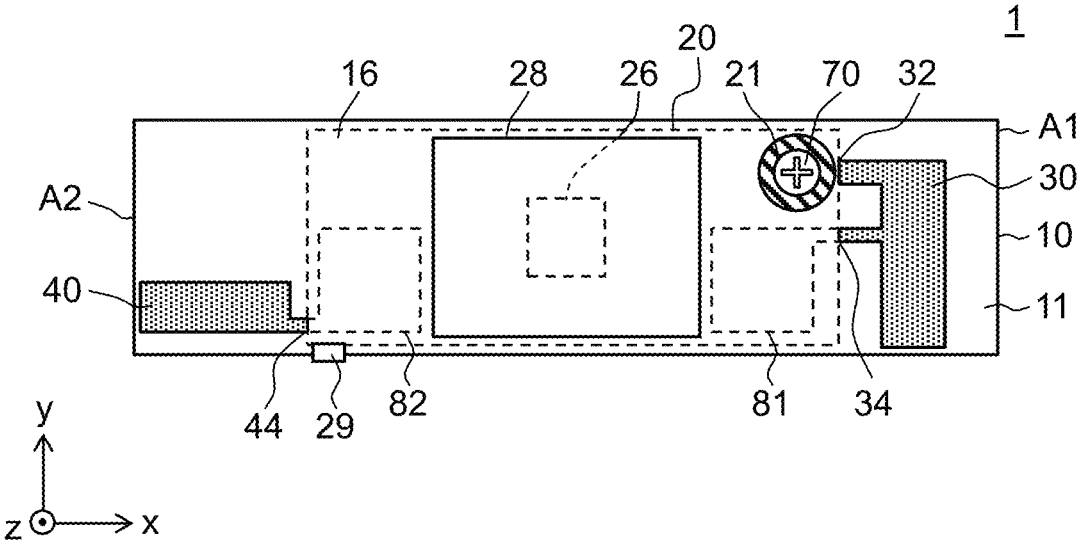
FIG. 1B is a top view schematically showing the example of the external appearance of the wireless module in the first exemplary embodiment.

FIG. 1B is a top view schematically showing the example of the external appearance of wireless module 1 in the first exemplary embodiment.

Figure 1C:
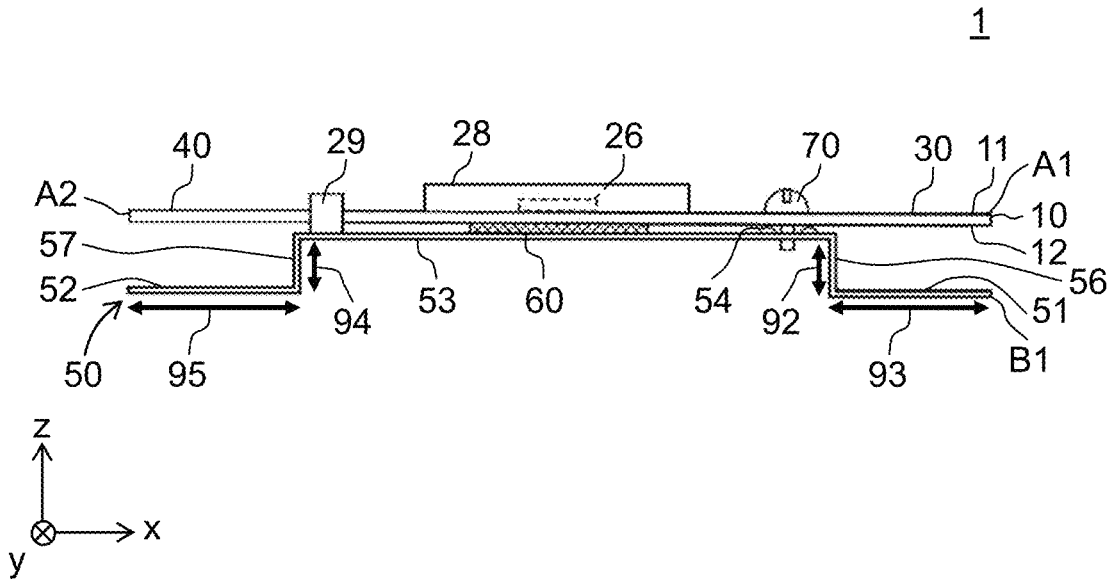
FIG. 1C is a side view schematically showing the example of the external appearance of the wireless module in the first exemplary embodiment.

FIG. 1C is a side view schematically showing the example of the external appearance of wireless module 1 in the first exemplary embodiment.

Figure 1D:
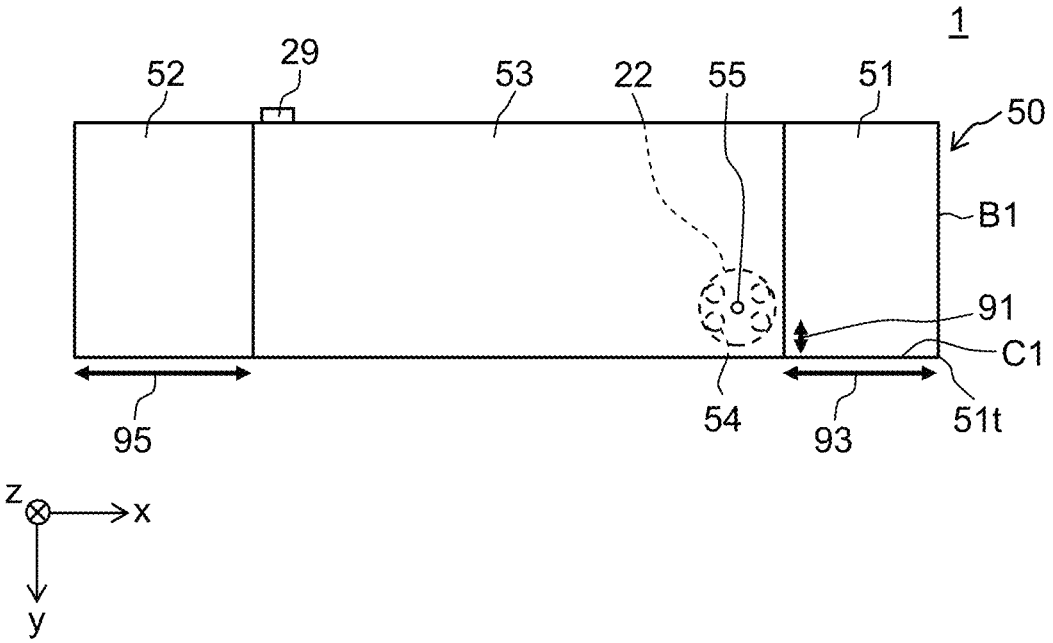
FIG. 1D is a bottom view schematically showing the example of the external appearance of the wireless module in the first exemplary embodiment.

FIG. 1D is a bottom view schematically showing the example of the external appearance of wireless module 1 in the first exemplary embodiment.

Figure 2:
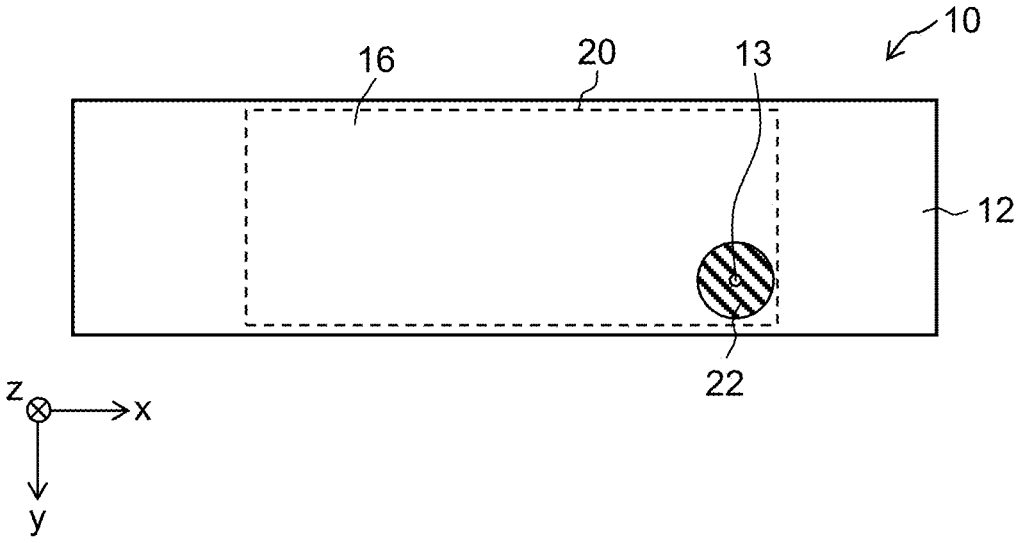
FIG. 2 is a bottom view schematically showing an example of an external appearance of a substrate of the wireless module in the first exemplary embodiment.

FIG. 2 is a bottom view schematically showing an example of an external appearance of substrate 10 of wireless module 1 in the first exemplary embodiment.

Note that, in the drawings used in the following description, three axes, i.e., an x-axis, a y-axis, and a z-axis are shown. An axis in a longitudinal direction of wireless module 1 is defined as the x-axis. An axis perpendicular to an x-axis direction and perpendicular to a main surface of substrate 10 of wireless module 1 is defined as a z-axis. An axis orthogonal to both the x-axis and the z-axis is defined as the y-axis. In the drawings used in the following description, the x-axis, the y-axis, and the z-axis are similarly defined as described above. However, these axes are shown only for convenience, and do not limit the present disclosure in any way.

Wireless module 1 according to the present exemplary embodiment is a wireless terminal that transmits and receives electromagnetic wave signals. For example, wireless module 1 is a wireless terminal based on a standard such as a wireless local area network (LAN) and Bluetooth (registered trademark). As shown in FIG. 1A, wireless module 1 includes substrate 10, ground patterns 20, first antenna 30, second antenna 40, and base plate 50. In the present exemplary embodiment, wireless module 1 further includes shield case 28, first matching circuit 81, second matching circuit 82, conductive screw 70, and spacer 29. As shown in FIG. 1C, wireless module 1 further includes integrated circuit (IC) 26 and heat conducting member 60. Wireless module 1 according to the present exemplary embodiment may be, for example, a wireless module of the Multi-Input Multi-Output (MIMO) method, diversity method, or the like.

As shown in FIG. 1B, substrate 10 is a circuit board on which ground patterns 20, first antenna 30, and second antenna 40 are formed and on which IC 26 is mounted. In the present exemplary embodiment, substrate 10 is a rectangular plate-shaped dielectric. Substrate 10 is, for example, a glass epoxy substrate. As shown in FIG. 1C, substrate 10 has first main surface 11 on which first antenna 30 and second antenna 40 are formed, and second main surface 12 opposite to first main surface 11.

As shown in FIGS. 1A to 1C, ground patterns 20 are wiring patterns formed on substrate 10. Ground patterns 20 are formed on first main surface 11 and second main surface 12 of substrate 10, and respective ground patterns 20 are electrically connected to each other via a sufficient number of via electrodes (not shown) or the like. Ground patterns 20 are formed, for example, of metal foil such as copper foil, and covered with resist 16. Resist 16 is an insulating film that protects the wiring patterns formed on substrate 10.

In the present exemplary embodiment, as shown in FIGS. 1A and 1B, ground pattern 20 includes exposed portion 21 provided on first main surface 11 of substrate 10. Moreover, as shown in FIG. 2, ground pattern 20 further includes exposed portion 22 provided on second main surface 12 of substrate 10. Exposed portion 21 and exposed portion 22 are portions which are not covered with resist 16 and exposed to the outside in ground patterns 20. That is, in the present exemplary embodiment, ground pattern 20 provided on first main surface 11 is covered with resist 16 except for exposed portion 21, and ground pattern 20 provided on second main surface 12 is covered with resist 16 except for exposed portion 22. In substrate 10, exposed portion 21 and exposed portion 22 are disposed at positions facing each other. Base plate 50 is short-circuited to ground patterns 20 via exposed portion 21 and exposed portion 22.

Note that the present exemplary embodiment describes a configuration example in which ground patterns 20 include exposed portion 21 and exposed portion 22; however, the present disclosure is not limited to this configuration example. In order to establish a short-circuit between ground patterns 20 and base plate 50, ground patterns 20 only need to include at least one of exposed portion 21 and exposed portion 22. However, uniformity of potential between ground patterns 20 can be enhanced by a configuration in which ground patterns 20 include both exposed portion 21 and exposed portion 22, and exposed portion 21 and exposed portion 22 are connected to each other via through hole 13 in substrate 10 by through hole processing, and by a configuration in which ground patterns 20 include both exposed portion 21 and exposed portion 22, and exposed portion 21 and exposed portion 22 are short-circuited to each other through via electrodes.

As shown in FIG. 2, through hole 13 is formed in a center of exposed portion 22 of ground pattern 20 on substrate 10. As shown in FIGS. 1A to 1C, conductive screw 70, which is an example of a fastening member, is inserted into through hole 13 from first main surface 11 of substrate 10. Conductive screw 70 is an example of a conductive fastening member having a threaded portion. Base plate 50 is fixed to substrate 10 by conductive screw 70 inserted into through hole 13. Moreover, exposed portion 21 of ground pattern 20 and base plate 50 are short-circuited to each other via conductive screw 70.

IC 26 is a circuit component, which is mounted on substrate 10 and connected to ground patterns 20. In the present exemplary embodiment, IC 26 is a component including a power amplifier or the like, and for example, is a wireless LAN chip. A high-frequency signal amplified by the power amplifier included in IC 26 is supplied to first antenna 30 and second antenna 40.

In the present exemplary embodiment, as shown in FIG. 1A, 1C 26 is covered with shield case 28. Shield case 28 is a metal box-shaped conductive member that covers IC 26 mounted on first main surface 11 of substrate 10. Shield case 28 suppresses entry of electromagnetic noise from an outside of shield case 28 to an inside of shield case 28, and also suppresses leakage of electromagnetic noise, which is generated in the inside of shield case 28, to the outside of shield case 28. In the present exemplary embodiment, shield case 28 is connected to ground pattern 20 by soldering or the like. In this way, an electromagnetic noise shielding effect by shield case 28 is enhanced. Note that shield case 28 may cover not only IC 26 but also other circuit elements.

As shown in FIGS. 1A and 1B, first antenna 30 is an antenna element disposed between one end A1 of substrate 10 and ground pattern 20 and including: first grounding part 32 connected to ground patterns 20; and first power feeding part 34 fed with a first signal. In the present exemplary embodiment, first antenna 30 is provided between one end A1 of substrate 10 in the x-axis direction (that is, in the longitudinal direction of substrate 10) and ground pattern 20. First antenna 30 is formed, for example, of metal foil such as copper foil. In the present exemplary embodiment, first antenna 30 is a planar inverted-F antenna (PIFA), and functions as an antenna in combination with base plate 50. A resonance frequency of first antenna 30 is not particularly limited, but may be about 2.4 GHz, for example. Note that the pattern shape of first antenna 30 is not limited to the shape illustrated in the drawings. For example, first antenna 30 may be a multi-band adaptable antenna adaptable for multi bands.

Although the present exemplary embodiment describes the configuration example where first antenna 30 is disposed on first main surface 11 of substrate 10, first antenna 30 may be disposed on second main surface 12.

First grounding part 32 of first antenna 30 is a grounding point connected to ground patterns 20. Ground pattern 20 on first main surface 11 and ground pattern 20 on second main surface 12 are electrically connected to each other via the via electrodes or the like as near first grounding part 32 as possible. For example, a distance from first grounding part 32 to the via electrodes is set to approximately 1/20 times or less a wavelength of an electromagnetic wave used in wireless module 1 (first antenna 30). First antenna 30 may be formed integrally with ground patterns 20, or may be connected to ground patterns 20 by soldering or the like.

First power feeding part 34 of first antenna 30 is a portion including a feeding point fed with a first signal from IC 26. The high-frequency signal output from IC 26 is supplied to first power feeding part 34 via first matching circuit 81. First antenna 30 may be formed integrally with a wiring pattern that configures first matching circuit 81, or may be connected to the wiring pattern by soldering or the like.

As shown in FIGS. 1A and 1B, second antenna 40 is an antenna element disposed between other end A2 of substrate 10 and ground pattern 20 and including second power feeding part 44 fed with a second signal. In the present exemplary embodiment, second antenna 40 is provided between other end A2 of substrate 10 in the x-axis direction (that is, in the longitudinal direction of substrate 10) and ground pattern 20. Second antenna 40 is formed, for example, of metal foil such as copper foil. In the present exemplary embodiment, second antenna 40 is a monopole antenna. Note that the pattern shape of second antenna 40 is not limited to the shape illustrated in the drawings. For example, second antenna 40 may be a PIFA, or a multi-band adaptable antenna adaptable for multi bands. A resonance frequency of second antenna 40 is not particularly limited, but may be about 2.4 GHz, for example.

Although the present exemplary embodiment describes the configuration example where second antenna 40 is disposed on first main surface 11 of substrate 10, second antenna 40 may be disposed on second main surface 12.

Second power feeding part 44 of second antenna 40 is a portion including a feeding point fed with the second signal from IC 26. The high-frequency signal output from IC 26 is supplied to second power feeding part 44 via second matching circuit 82. Second antenna 40 may be formed integrally with a wiring pattern that configures second matching circuit 82, or may be connected to the wiring pattern by soldering or the like.

First matching circuit 81 is an impedance matching circuit for suppressing reflection, at first antenna 30, of the high-frequency signal which is output from IC 26. The high-frequency signal output from IC 26 is input to first matching circuit 81. Moreover, first matching circuit 81 outputs the high-frequency signal to first power feeding part 34 of first antenna 30. In the present exemplary embodiment, on first main surface 11 of substrate 10, first matching circuit 81 is disposed between IC 26 and first antenna 30.

Second matching circuit 82 is an impedance matching circuit for suppressing reflection, at second antenna 40, of the high-frequency signal which is output from IC 26. The high-frequency signal output from IC 26 is input to second matching circuit 82. Moreover, second matching circuit 82 outputs the high-frequency signal to second power feeding part 44 of second antenna 40. In the present exemplary embodiment, on first main surface 11 of substrate 10, second matching circuit 82 is disposed between IC 26 and second antenna 40.

Base plate 50 is a conductive plate-shaped member and includes first opposed portion 51 facing first antenna 30, second opposed portion 52 facing second antenna 40, and third opposed portion 53 that faces ground patterns 20 and is short-circuited to ground patterns 20. Base plate 50 further includes first gap formation portion 56 and second gap formation portion 57. Base plate 50 has, on third opposed portion 53, short-circuit points at which base plate 50 and ground patterns 20 are short-circuited to each other. The short-circuit points are disposed on third opposed portion 53 at positions nearer to first opposed portion 51 than to second opposed portion 52. The short-circuit points will be described later. Base plate 50 functions as an antenna together with first antenna 30.

Base plate 50 has a configuration for enhancing isolation between first antenna 30 and second antenna 40. This configuration will be described later. It is to be noted that base plate 50 may function as a heat radiation member which radiates heat generated in IC 26.

In the present exemplary embodiment, base plate 50 has a shape being bent into a convex shape as shown in FIGS. 1A and 1C. Base plate 50 is formed, for example, of a metal material such as aluminum, iron, and alloys of a variety of metals.

First opposed portion 51 of base plate 50 is a portion disposed so as to face first antenna 30. The wording "first opposed portion 51 faces first antenna 30" is not limited to a configuration where first opposed portion 51 and first antenna 30 directly face each other without having substrate 10 or the like interposed therebetween. This wording also includes a configuration where first opposed portion 51 and first antenna 30 face each other with a non-conductive member such as substrate 10 interposed therebetween. For example, a configuration in which first antenna 30 is disposed on first main surface 11 of substrate 10 and a configuration in which first antenna 30 is disposed on second main surface 12 of substrate 10 are both included in the configuration in which first opposed portion 51 of base plate 50 is disposed so as to face first antenna 30.

In the present exemplary embodiment, first opposed portion 51 has a substantially flat plate shape, and is disposed apart from first antenna 30 and substrate 10. That is, a gap is formed between first opposed portion 51 and first antenna 30. A distance between first opposed portion 51 and first antenna 30 is, for example, approximately from 1/30 (inclusive) to 1/10 (inclusive) times the wavelength of the electromagnetic wave used in wireless module 1 (first antenna 30).

First gap formation portion 56 of base plate 50 is disposed between first opposed portion 51 and third opposed portion 53, and is a plate-shaped portion connecting first opposed portion 51 and third opposed portion 53. First gap formation portion 56 is disposed in a plane that intersects substrate 10, thereby forming a gap between first opposed portion 51 and first antenna 30. In the present exemplary embodiment, first gap formation portion 56 is disposed in a plane substantially perpendicular to substrate 10.

Third opposed portion 53 of base plate 50 is a plate-shaped portion facing ground patterns 20 and short-circuited to ground patterns. In the present exemplary embodiment, base plate 50 further includes one or a plurality (for example, four) of protrusions 54 on third opposed portion 53 as shown in FIGS. 1C and 1D. As shown in FIG. 1D, protrusions 54 are disposed at positions facing exposed portion 22 of ground pattern 20 so as to be in contact with exposed portion 22. Thus, base plate 50 is short-circuited to ground patterns 20.

As shown in FIG. 1D, in base plate 50, threaded hole 55 is provided at a position corresponding to through hole 13, and the threaded portion of conductive screw 70 that penetrates through hole 13 from first main surface 11 is screwed into threaded hole 55. In this way, base plate 50 is fixed to substrate 10, and is short-circuited to exposed portion 21 of ground pattern 20 via conductive screw 70. That is, in wireless module 1 according to the present exemplary embodiment, protrusions 54 and threaded hole 55 of base plate 50 constitute short-circuit points at which base plate 50 and ground patterns 20 are short-circuited to each other.

Wireless module 1 according to the present exemplary embodiment has the configuration described above, and thus, base plate 50 can be easily attached to substrate 10, and base plate 50 can be short-circuited to ground patterns 20 with increased accuracy. Moreover, in the configuration described in the present exemplary embodiment, base plate 50 is attached to substrate 10 by means of conductive screw 70, whereby base plate 50 can be easily attached to and detached from substrate 10.

In the present exemplary embodiment, five short-circuit points in total, that is, four protrusions 54 and threaded hole 55, are provided in wireless module 1. However, a number of the short-circuit points provided in wireless module 1 is not limited to five. For example, only one short-circuit point may be provided. As described above, wireless module 1 according to the present exemplary embodiment does not need to have short-circuit members at two positions as in the wireless communication device disclosed in PTL 1.

A position at which base plate 50 and ground patterns 20 are short-circuited to each other, that is, positions where exposed portion 21 and exposed portion 22 are disposed, greatly affect radiation characteristics of an antenna unit configured by first antenna 30 and base plate 50. When the short-circuit point at which base plate 50 and ground patterns 20 are short-circuited to each other, is disposed as near first grounding part 32 as possible, excellent and stable radiation characteristics can be obtained as the antenna unit. For example, when wireless module 1 employs a configuration in which exposed portion 21 is directly connected to first grounding part 32 or a configuration in which the distance between first grounding part 32 and the short-circuit point, at which base plate 50 and ground patterns 20 are short-circuited to each other, is set to be approximately 1/20 times or less a wavelength of an electromagnetic wave used in wireless module 1, stable radiation characteristics can be obtained in wireless module 1.

The portion of third opposed portion 53 other than protrusions 54 is disposed apart from ground pattern 20 by a predetermined distance. The predetermined distance is, for example, from 1/500 (inclusive) to 1/50 (inclusive) times a resonance wavelength of first antenna 30. In the present exemplary embodiment, the predetermined distance is approximately 0.5 mm.

Second opposed portion 52 of base plate 50 is a portion disposed so as to face second antenna 40. In the present exemplary embodiment, second opposed portion 52 has a substantially flat plate shape, and is disposed apart from second antenna 40 and substrate 10. That is, a gap is formed between second opposed portion 52 and second antenna 40. A distance between second opposed portion 52 and second antenna 40 is, for example, approximately from 1/30 (inclusive) to 1/10 (inclusive) times the wavelength of the electromagnetic wave used in wireless module 1 (second antenna 40).

Second gap formation portion 57 of base plate 50 is disposed between second opposed portion 52 and third opposed portion 53, and is a plate-shaped portion connecting second opposed portion 52 and third opposed portion 53. Second gap formation portion 57 is disposed in a plane that intersects substrate 10, thereby forming a gap between second opposed portion 52 and second antenna 40. In the present exemplary embodiment, second gap formation portion 57 is disposed in a plane substantially perpendicular to substrate 10.

Spacer 29 is a member for stably maintaining the gap between substrate 10 and third opposed portion 53 of base plate 50. In the present exemplary embodiment, spacer 29 has a plate shape and is bent into a substantially U shape. A part of spacer 29 is inserted between substrate 10 and third opposed portion 53. The thickness of the part of spacer 29 inserted between substrate 10 and third opposed portion 53 is substantially equal to the space between substrate 10 and third opposed portion 53. Thus, the space between substrate 10 and third opposed portion 53 is stably maintained. Spacer 29 is formed of an insulating material. Spacer 29 is formed of an insulating resin, for example.

Heat conducting member 60 is a member disposed between base plate 50 and IC 26 and conducting the heat generated in IC 26 to base plate 50. Heat conducting member 60 is disposed at a position, which faces IC 26, between second main surface 12 of substrate 10 and base plate 50. Moreover, heat conducting member 60 is disposed so as to be in contact with second main surface 12 and base plate 50. Heat conducting member 60 includes, for example, a thermally conductive elastomer as a material for use. In the present exemplary embodiment, heat conducting member 60 is formed of heat radiating rubber including silicone or the like as a material for use. Therefore, heat conducting member 60 has elasticity, whereby adhesion between substrate 10 and base plate 50 can be enhanced. Thus, in wireless module 1, thermal resistance between substrate 10 and base plate 50 can be reduced.

[1-2. Configuration of Base Plate]

Next, base plate 50 according to the present exemplary embodiment will be described.

Base plate 50 according to the present exemplary embodiment has a configuration for enhancing isolation between first antenna 30 and second antenna 40 as described above. That is, base plate 50 has a configuration capable of reducing interference of the electromagnetic wave output from one of the antennas to the other antenna.

In the present exemplary embodiment, base plate 50 has, on third opposed portion 53, the short-circuit points at which base plate 50 and ground patterns 20 are short-circuited to each other. The short-circuit points are disposed on third opposed portion 53 at positions nearer to first opposed portion 51 than to second opposed portion 52. Thus, a portion of current flowing from first grounding part 32 of first antenna 30 toward ground pattern 20 flows into base plate 50. Due to the reduction in the current flowing from first antenna 30 toward ground pattern 20 as described above, current flowing through ground pattern 20 to the vicinity of second antenna 40 is reduced. Thus, in wireless module 1, an impact of the current flowing from first antenna 30 to ground pattern 20 on second antenna 40 can be suppressed. That is, in wireless module 1, isolation between first antenna 30 and second antenna 40 can be enhanced.

In addition, in wireless module 1, the isolation between both antennas (first antenna 30 and second antenna 40) can be enhanced by setting an electrical length from the short-circuit point, at which base plate 50 and ground patterns 20 are short-circuited to each other, to vertex 51*t* of base plate 50 closest to the short-circuit point to a predetermined length.

Now, the electrical length from the short-circuit point, at which base plate 50 and ground patterns 20 are short-circuited to each other, to vertex 51*t* of base plate 50 closest to the short-circuit point will be described with reference to FIG. 1A. In the present exemplary embodiment, base plate 50 has four vertices at positions where respective edges of both ends in the x-axis direction and respective edges of both ends in the y-axis direction intersect. In the present exemplary embodiment, the vertex of base plate 50 closest to the short-circuit point is vertex 51*t* where the edge of end B1 of base plate 50 in the x-axis direction and the edge of end C1 in the y-axis direction intersect (see FIGS. 1A and 1D).

The electrical length from the short-circuit point, at which base plate 50 and ground patterns 20 are short-circuited to each other, to vertex 51*t* is defined by a sum of the distance (distance indicated by arrow 91 in FIGS. 1A and 1D) from the short-circuit point to a point corresponding to a foot of a perpendicular line from the short-circuit point to the edge of base plate 50 closest to the short-circuit point and the length of the edge of base plate 50 from this point to vertex 51*t*. In the present exemplary embodiment, when the electrical length from the short-circuit point, at which base plate 50 and ground patterns 20 are short-circuited to each other, to vertex 51*t* of base plate 50 closest to the short-circuit point is schematically represented, this length is represented as the sum of the lengths of arrow 91, arrow 92, and arrow 93 shown in FIG. 1A. In the present exemplary embodiment, four protrusions 54 and threaded hole 55 in base plate 50 correspond to the short-circuit points. In this case, the electrical length from the short-circuit point to vertex 51*t* is defined as the shortest electrical length from among the electrical lengths from vertex 51*t* to the respective short-circuit points.

The inventors of the present application have found that the isolation between both antennas (first antenna 30 and second antenna 40) can be enhanced by setting the electrical length to be approximately ¼ times the resonance wavelength of first antenna 30. Herein, the state of approximately ¼ times the resonance wavelength specifically means that the electrical length is approximately from ⅛ (inclusive) to ⅜ (inclusive) times the resonance wavelength. The cause of the correlation between the electrical length and the isolation between both antennas is assumed as described below.

When power is supplied to first antenna 30, antenna current is generated between first antenna 30 and ground pattern 20. In a case where the electrical length from the short-circuit point, at which base plate 50 and ground patterns 20 are short-circuited to each other, to vertex 51*t* is approximately ¼ times the resonance wavelength, a standing wave is generated where vertex 51*t* is the node of the current and the short-circuit point is the antinode of the current. Thus, the antenna current flowing to ground pattern 20 is distributed into a path leading to second antenna 40 and a path leading to first opposed portion 51, and therefore, the current input to second antenna 40 is reduced. Accordingly, it is assumed that, when the electrical length from the short-circuit point, at which base plate 50 and ground patterns 20 are short-circuited to each other, to vertex 51*t* is approximately ¼ times the resonance wavelength, the isolation between both antennas can be enhanced in wireless module 1.

In addition, the present inventors have also found that the isolation between both antennas can be enhanced in wireless module 1 by optimizing the dimension of a portion of base plate 50 near second antenna 40. Specifically, the present inventors have found that the isolation between both antennas can be enhanced in wireless module 1 by setting an electrical length in base plate 50 from an end of third opposed portion 53 closer to second opposed portion 52 to the opposite end of second opposed portion 52 from third opposed portion 53 to be approximately ¼ times the resonance wavelength of first antenna 30. Herein, the state of approximately ¼ times the resonance wavelength also specifically means that the electrical length is approximately from ⅛ (inclusive) to ⅜ (inclusive) times the resonance wavelength. In the present exemplary embodiment, when the electrical length is schematically represented, this length is represented as a sum of the length of the edge of second gap formation portion 57 indicated by arrow 94 in FIGS. 1A and 1C and the length, indicated by arrow 95 in FIGS. 1A and 1C, from the edge of second opposed portion 52 closer to third opposed portion 53 to the opposite edge of second opposed portion 52 from third opposed portion 53.

As described above, the dimension of base plate 50 in the width direction (y-axis direction) of base plate 50 near second antenna 40 is not limited. This is associated with the fact that, near second antenna 40, the flowing direction of the current from the short-circuit point, at which base plate 50 and ground patterns 20 are short-circuited to each other, to base plate 50 becomes substantially parallel to the longitudinal direction (x-axis direction) of base plate 50, resulting in reducing an impact of the widthwise dimension of base plate 50 on the current.

As described above, in wireless module 1, the isolation between first antenna 30 and second antenna 40 can be enhanced by optimizing the dimension of base plate 50. In addition, the isolation characteristics in the present exemplary embodiment are more insensitive to the change in resonance wavelength than the isolation characteristics in the technology using slits disclosed in the PTL 1, for example. That is, in wireless module 1 in the present exemplary embodiment, the isolation between first antenna 30 and second antenna 40 can be ensured in relatively a wide frequency band. In wireless module 1 according to the present exemplary embodiment, it is also possible to use first antenna 30 and second antenna 40 in frequency bands adjacent to each other. For example, first antenna 30 can be used as an antenna for Bluetooth (registered trademark) in a frequency band of approximately 2.4 GHz, and second antenna 40 can be used as an antenna for wireless LAN in a frequency band of approximately 2.4 GHz.

[1-3. Effects and Others]

As described above, in the present exemplary embodiment, the wireless module includes; a substrate; a ground pattern disposed on the substrate; a first antenna; a second antenna; and a base plate that is conductive. The first antenna is disposed between one end of the substrate and the ground pattern, and includes a grounding part and a first power feeding part, the grounding part is connected to the ground pattern, and the first power feeding part is fed with a first signal. The second antenna is disposed between the other end of the substrate and the ground pattern, and includes a second power feeding part fed with a second signal. The base plate includes a first opposed portion that faces the first antenna, a second opposed portion that faces the second antenna, and a third opposed portion that faces the ground pattern and is short-circuited to the ground pattern. The base plate also has, on the third opposed portion, a short-circuit point at which the base plate and the ground pattern are short-circuited to each other. The short-circuit point is disposed on the third opposed portion at a position nearer to the first opposed portion than to the second opposed portion.

Note that wireless module 1 is an example of the wireless module. Substrate 10 is an example of the substrate. Each of ground patterns 20 is an example of the ground pattern. First antenna 30 is an example of the first antenna. Second antenna 40 is an example of the second antenna. Base plate 50 is an example of the base plate. One end A1 is an example of one end of the substrate. First grounding part 32 is an example of the grounding part. First power feeding part 34 is an example of the first power feeding part. Other end A2 is an example of the other end of the substrate. Second power feeding part 44 is an example of the second power feeding part. First opposed portion 51 is an example of the first opposed portion. Second opposed portion 52 is an example of the second opposed portion. Third opposed portion 53 is an example of the third opposed portion.

For example, in the example shown in the first exemplary embodiment, wireless module 1 includes substrate 10 and ground patterns 20 disposed on substrate 10. Wireless module 1 also includes first antenna 30 which is disposed between one end A1 of substrate 10 and ground pattern 20 and which includes first grounding part 32 and first power feeding part 34, first grounding part 32 is connected to ground patterns 20, and first power feeding part 34 is fed with a first signal. Wireless module 1 also includes second antenna 40 which is disposed between other end A2 of substrate 10 and ground pattern 20 and which includes second power feeding part 44 fed with a second signal. Wireless module 1 also includes base plate 50 which is conductive and includes first opposed portion 51 that faces first antenna 30, second opposed portion 52 that faces second antenna 40, and third opposed portion 53 that faces ground patterns 20 and is short-circuited to ground patterns 20. Base plate 50 has, on third opposed portion 53, a short-circuit point at which base plate 50 and ground patterns 20 are short-circuited to each other. The short-circuit point is disposed on third opposed portion 53 at a position nearer to first opposed portion 51 than to second opposed portion 52.

In wireless module 1 thus configured, a portion of current flowing from first grounding part 32 of first antenna 30 toward ground patterns 20 flows into base plate 50. Due to the reduction in the current flowing from first antenna 30 toward ground patterns 20 as described above, current flowing through ground patterns 20 to the vicinity of second antenna 40 is reduced in wireless module 1. Therefore, in wireless module 1, the isolation between first antenna 30 and second antenna 40 can be enhanced.

In the wireless module, the short-circuit point may be disposed near the grounding part.

For example, in wireless module 1 in the example shown in the first exemplary embodiment, the short-circuit points are disposed near first grounding part 32.

Thus, in wireless module 1, satisfactory radiation characteristics are obtained in the antenna unit including first antenna 30 and base plate 50.

In the wireless module, an electrical length from the short-circuit point to a vertex of the base plate closest to the short-circuit point may be approximately ¼ times a resonance wavelength of the first antenna.

Note that vertex 51*t* is an example of the vertex of the base plate closest to the short-circuit point.

For example, in wireless module 1 in the example shown in the first exemplary embodiment, an electrical length from the short-circuit point, at which base plate 50 and ground patterns 20 are short-circuited to each other, to vertex 51*t* of base plate 50 closest to the short-circuit point is approximately ¼ times the resonance wavelength of first antenna 30.

According to this configuration, in wireless module 1, the isolation between first antenna 30 and second antenna 40 can be enhanced.

In the wireless module, an electrical length from an end of the third opposed portion closer to the second opposed portion to an opposite end of the second opposed portion from the third opposed portion may be approximately ¼ times a resonance wavelength of the first antenna.

For example, in wireless module 1 in the example shown in the first exemplary embodiment, an electrical length in base plate 50 from an end of third opposed portion 53 closer to second opposed portion 52 to an opposite end of second opposed portion 52 from third opposed portion 53 is approximately ¼ times the resonance wavelength of first antenna 30.

Thus, in wireless module 1, the isolation between first antenna 30 and second antenna 40 can be enhanced.

The wireless module may further include a conductive fastening member that is disposed on the short-circuit point and fastens the substrate and the base plate to each other.

Note that conductive screw 70 is an example of the conductive fastening member.

For example, in the example shown in the first exemplary embodiment, wireless module 1 further includes conductive screw 70 that is disposed on the short-circuit point and fastens substrate 10 and base plate 50 to each other.

Thus, in wireless module 1, base plate 50 can be stably fixed to substrate 10. Further, due to the use of conductive screw 70 as the fastening member, base plate 50 can be easily attached to and removed from substrate 10. In addition, in wireless module 1, ground patterns 20 and base plate 50 can be short-circuited to each other via conductive screw 70 by bringing conductive screw 70 into contact with exposed portion 21 of ground pattern 20.

In the wireless module, the first antenna may be a planar inverted-F antenna (PIFA).

For example, in wireless module 1 in the example shown in the first exemplary embodiment, first antenna 30 is the PIFA.

In this case, in wireless module 1, first antenna 30 functions as an antenna in combination with base plate 50.

Second Exemplary Embodiment

Next, wireless module 101 according to a second exemplary embodiment will be described.

Wireless module 101 according to this exemplary embodiment has substantially the same configuration as wireless module 1 described in the first exemplary embodiment. However, wireless module 101 described in the second exemplary embodiment is different from wireless module 1 according to the first exemplary embodiment in positions of short-circuit points at which the base plate and the ground pattern are short-circuited to each other. Hereinafter, with regard to wireless module 101 according to the present exemplary embodiment, a description of the matters described in the first exemplary embodiment will be omitted as appropriate, and points of difference from wireless module 1 according to the first exemplary embodiment will be mainly described. Note that constituent elements substantially the same as the constituent elements included in wireless module 1 described in the first exemplary embodiment are denoted by the same reference numerals, and a description thereof is omitted or simplified.

[2-1. Configuration]

First, a configuration of wireless module 101 in the present exemplary embodiment will be described with reference to the drawings.

Figure 3A:
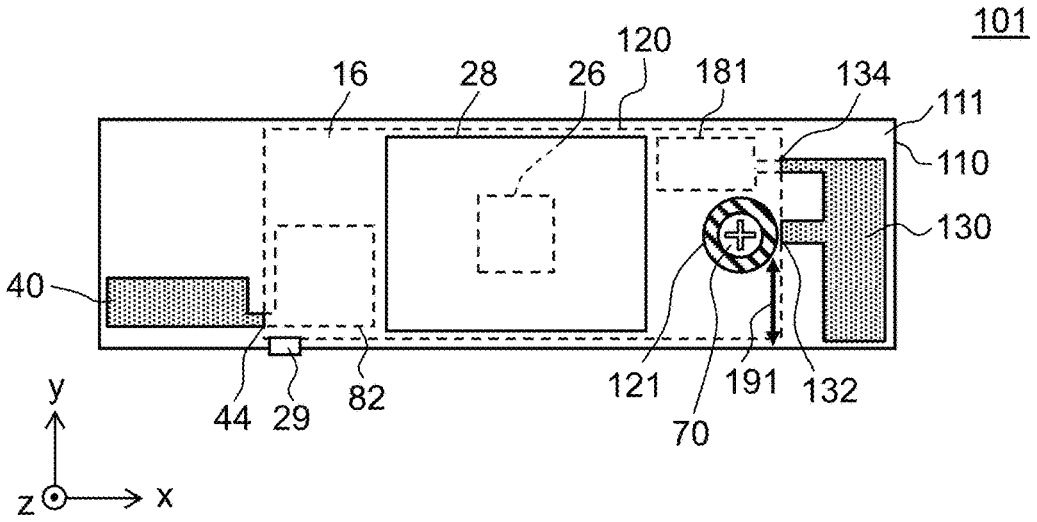
FIG. 3A is a top view schematically showing an example of an external appearance of a wireless module in a second exemplary embodiment.

FIG. 3A is a top view schematically showing an example of an external appearance of wireless module 101 in the second exemplary embodiment.

Figure 3B:
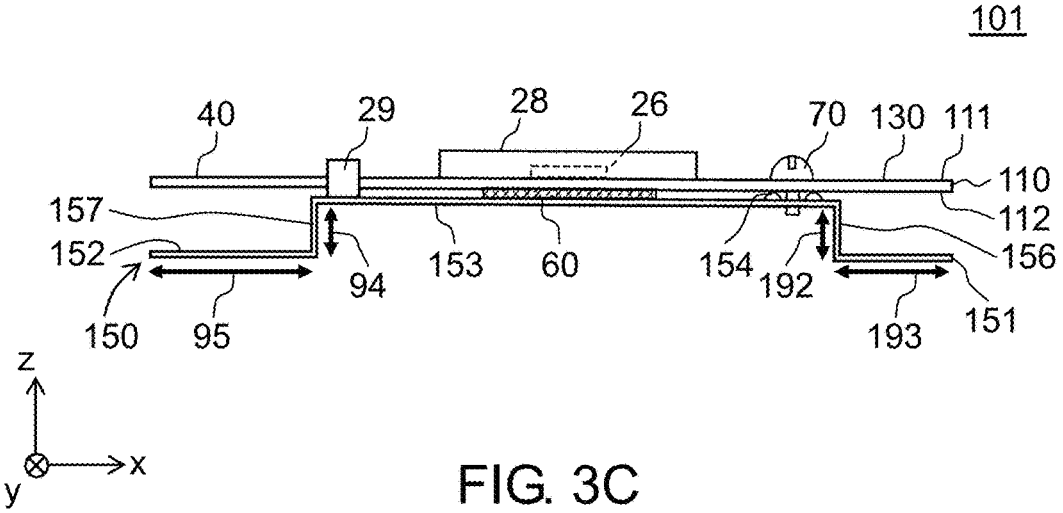
FIG. 3B is a side view schematically showing the example of the external appearance of the wireless module in the second exemplary embodiment.

FIG. 3B is a side view schematically showing the example of the external appearance of wireless module 101 in the second exemplary embodiment.

Figure 3C:
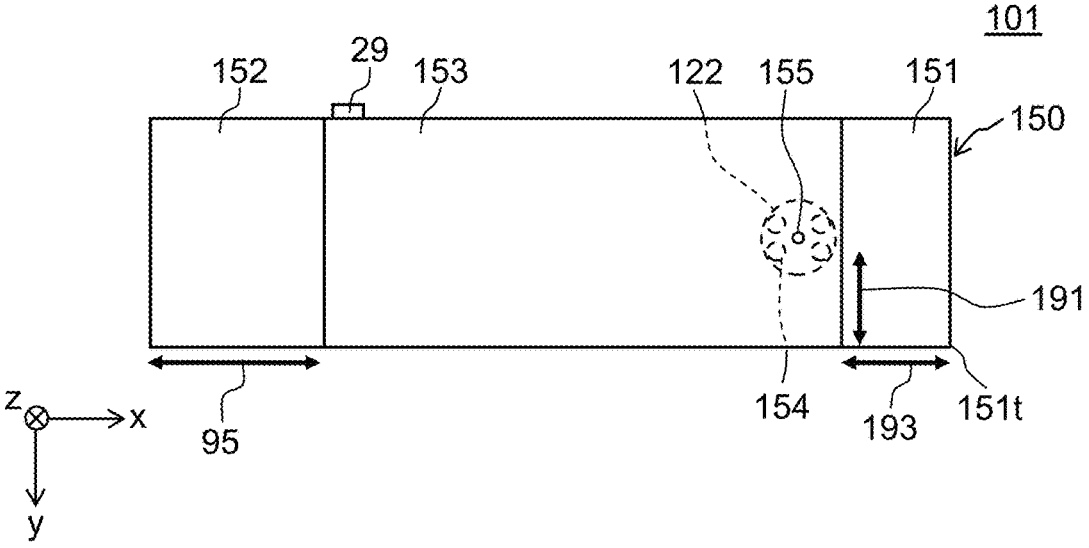
FIG. 3C is a bottom view schematically showing the example of the external appearance of the wireless module in the second exemplary embodiment.

FIG. 3C is a bottom view schematically showing the example of the external appearance of wireless module 101 in the second exemplary embodiment.

Figure 4:
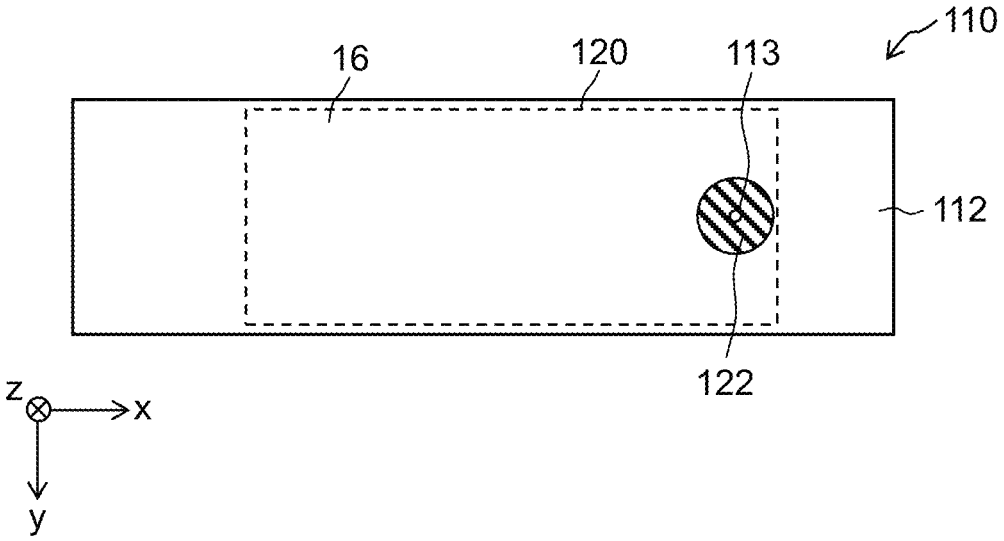
FIG. 4 is a bottom view schematically showing an example of an external appearance of a substrate of the wireless module in the second exemplary embodiment.

FIG. 4 is a bottom view schematically showing an example of an external appearance of substrate 110 of wireless module 101 in the second exemplary embodiment.

As shown in FIG. 3A, wireless module 101 includes substrate 110, ground patterns 120, IC 26, shield case 28, first antenna 130, second antenna 40, first matching circuit 181, second matching circuit 82, and spacer 29. Wireless module 101 also includes base plate 150, conductive screw 70, and heat conducting member 60, as shown in FIG. 3B.

As shown in FIG. 3A, ground pattern 120 includes exposed portion 121 provided on first main surface 111 of substrate 110. Moreover, as shown in FIG. 4, ground pattern 120 further includes exposed portion 122 provided on second main surface 112 of substrate 110. Exposed portion 121 and exposed portion 122 are portions, which are not covered with resist 16 and exposed to the outside, in ground patterns 120. Exposed portion 121 and exposed portion 122 are disposed at positions facing each other. In the present exemplary embodiment, exposed portion 121 and exposed portion 122 are formed in the center of substrate 110 in the width direction (y-axis direction).

As shown in FIG. 3B, substrate 110 has first main surface 111 on which first antenna 130 and second antenna 40 are formed, and second main surface 112 opposite to first main surface 111. As shown in FIG. 4, through hole 113 is formed in centers of exposed portion 121 and exposed portion 122 of ground patterns 120 on substrate 110.

Substrate 110 is different from substrate 10 in the first exemplary embodiment mainly in that an arrangement position of first power feeding part 134 and first grounding part 132 of first antenna 130 on substrate 110 is different from the arrangement position of first power feeding part 34 and first grounding part 32 of first antenna 30 on substrate 10. On substrate 110, first grounding part 132 of first antenna 130 is disposed near the center of substrate 110 in the width direction (y-axis direction) according to the positions where exposed portion 121 and exposed portion 122 of ground patterns 120 are disposed. On the other hand, on substrate 110, first power feeding part 134 of first antenna 130 is disposed near an end of substrate 110 in the width direction so as not to interfere with first grounding part 132.

First matching circuit 181 is a circuit substantially the same as first matching circuit 81 according to the first exemplary embodiment. However, the layout of first matching circuit 181 on substrate 110 is different from the layout of first matching circuit 81 on substrate 10 in the first exemplary embodiment. On substrate 110, first matching circuit 181 is disposed at a position not interfering with the position where exposed portion 121 of ground pattern 120 is disposed. Further, a position of an output unit of first matching circuit 181 is set according to the position where first power feeding part 134 of first antenna 130 is disposed.

Base plate 150 includes first opposed portion 151, second opposed portion 152, third opposed portion 153, first gap formation portion 156, and second gap formation portion 157 (see FIG. 3B), as in base plate 50 described in the first exemplary embodiment. Base plate 150 also has, on third opposed portion 153, short-circuit points at which base plate 150 and ground patterns 120 are short-circuited to each other. The short-circuit points are disposed on third opposed portion 153 at positions nearer to first opposed portion 151 than to second opposed portion 152.

Base plate 150 includes one or a plurality (for example, four) of protrusions 154 on third opposed portion 153 as shown in FIG. 3C. Protrusions 154 are disposed at positions facing exposed portion 122 of ground pattern 120 so as to be in contact with exposed portion 122. In addition, in base plate 150, threaded hole 155 is provided at a position corresponding to through hole 113, and the threaded portion of conductive screw 70 that penetrates through hole 113 from first main surface 111 of substrate 110 is screwed into threaded hole 155. In this way, base plate 150 is fixed to substrate 110, and is short-circuited to exposed portion 121 of ground pattern 120 via conductive screw 70. Further, exposed portion 122 and protrusions 154 are short-circuited. Thus, in wireless module 101 according to the present exemplary embodiment, protrusions 154 and threaded hole 155 of base plate 150 constitute short-circuit points at which base plate 150 and ground patterns 120 are short-circuited to each other.

Base plate 150 according to the present exemplary embodiment is different from base plate 50 according to the first exemplary embodiment in that protrusions 154 and threaded hole 155 are disposed in substantially the center in an edge direction, which is along an edge closer to first opposed portion 151, of third opposed portion 153, according to the positions where exposed portion 121 and exposed portion 122 of ground patterns 120 are disposed. Here, the edge direction means the width direction (y-axis direction) of base plate 150, and substantially the center in the edge direction means an area of about 10% of the width of base plate 150 from the center in the width direction of base plate 150. Moreover, in base plate 150 according to the present exemplary embodiment, the length of first opposed portion 151 in the x-axis direction is different from the length of first opposed portion 51 in the x-axis direction in the first exemplary embodiment. The length of first opposed portion 151 in the x-axis direction will be described later.

[2-2. Configuration of Base Plate]

Next, base plate 150 according to the present exemplary embodiment will be described.

In the present exemplary embodiment, base plate 150 also has, on third opposed portion 153, short-circuit points at which base plate 150 and ground patterns 120 are short-circuited to each other, as in base plate 50 in the first exemplary embodiment. The short-circuit points are disposed on third opposed portion 153 at positions nearer to first opposed portion 151 than to second opposed portion 152. Thus, a portion of current flowing from first grounding part 132 of first antenna 130 toward ground pattern 120 flows into base plate 150. Accordingly, in wireless module 101, isolation between first antenna 130 and second antenna 40 can be enhanced, as in wireless module 1 in the first exemplary embodiment.

In addition, in wireless module 101 in the present exemplary embodiment, an electrical length from the short-circuit point, at which base plate 150 and ground patterns 120 are short-circuited to each other, to vertex 151*t* (see FIG. 3C) of base plate 150 closest to the short-circuit point is also determined, as in wireless module 1 in the first exemplary embodiment. When the electrical length is schematically represented, this length is represented as a sum of lengths of arrow 191, arrow 192, and arrow 193 shown in FIGS. 3A to 3C. The electrical length is approximately ¼ times a resonance wavelength of first antenna 130. Further, an electrical length in base plate 150 from an end of third opposed portion 153 closer to second opposed portion 152 to an opposite end of second opposed portion 152 from third opposed portion 153 is approximately ¼ times the resonance wavelength of first antenna 130, as in wireless module 1 in the first exemplary embodiment. Note that this electrical length is schematically represented as a sum of a distance indicated by arrow 94 and a distance indicated by arrow 95 in FIGS. 3B and 3C.

According to the configuration described above, in wireless module 101, the isolation between both antennas (first antenna 130 and second antenna 40) can further be enhanced. In addition, in the present exemplary embodiment, the short-circuit points at which base plate 150 and ground patterns 120 are short-circuited to each other are disposed in substantially the center of base plate 150 in the width direction (y-axis direction). Therefore, the distance (distance indicated by arrow 191 in FIGS. 3A and 3C) from the short-circuit point to a point corresponding to a foot of a perpendicular line from the short-circuit point to an edge of base plate 150 closest to the short-circuit point is longer than the corresponding distance (distance indicated by arrow 91 in FIGS. 1A and 1D) in the first exemplary embodiment.

In the present exemplary embodiment, the electrical length from the short-circuit point, at which base plate 150 and ground patterns 120 are short-circuited to each other, to vertex 151*t* of base plate 150 closest to the short-circuit point is also set to be approximately ¼ times the resonance wavelength of first antenna 130. Therefore, the length of the edge of base plate 150 from the point corresponding to the foot of the perpendicular line to vertex 151*t* is set shorter than the corresponding length in the first exemplary embodiment by an increased amount of the distance indicated by arrow 191 compared to the distance indicated by arrow 91 in the first exemplary embodiment. For example, when the length (distance indicated by arrow 192 in FIG. 3B) of first gap formation portion 156 in the z-axis direction is equal to the length (distance indicated by arrow 92 in FIG. 1C) of first gap formation portion 56 in the z-axis direction in the first exemplary embodiment, the length (distance indicated by arrow 193 in FIGS. 3B and 3C) of first opposed portion 151 of base plate 150 in the x-axis direction can be decreased, in the present exemplary embodiment. In this way, wireless module 101 can be downsized. Thus, cost required for base plate 150 can be reduced.

[2-3. Effects and Others]

As described above, the wireless module according to the present exemplary embodiment has a configuration substantially the same as the configuration of the wireless module in the first exemplary embodiment, and can provide substantially the same effect.

Note that wireless module 101 is an example of the wireless module. Substrate 110 is an example of the substrate. Each of ground patterns 120 is an example of the ground pattern. First antenna 130 is an example of the first antenna. Base plate 150 is an example of the base plate. First grounding part 132 is an example of the grounding part. First power feeding part 134 is an example of the first power feeding part. First opposed portion 151 is an example of the first opposed portion. Second opposed portion 152 is an example of the second opposed portion. Third opposed portion 153 is an example of the third opposed portion.

In the wireless module, the short-circuit point may be disposed in substantially a center in an edge direction of the third opposed portion, the edge direction may be along an edge closer to the first opposed portion.

For example, in wireless module 101 in the example described in the second exemplary embodiment, the short-circuit points, at which base plate 150 and ground patterns 120 are short-circuited to each other, are disposed in substantially the center in the edge direction of third opposed portion 153, the edge direction is along the edge closer to first opposed portion 151.

It is to be noted that substantially the center may be defined such that exposed portion 121 or exposed portion 122 is disposed at a position including the center, for example.

Thus, in wireless module 101, the electrical length (distance indicated by arrow 191 in FIGS. 3A and 3C) from the short-circuit point, at which base plate 150 and ground patterns 120 are short-circuited to each other, to the edge of base plate 150 in the electrical length from the short-circuit point to vertex 151*t* of base plate 150 closest to the short-circuit point can be relatively increased. Therefore, in a case where the electrical length from the short-circuit point to vertex 151*t* is set to be approximately ¼ times the resonance wavelength of first antenna 130, first opposed portion 151 and first gap formation portion 156 of base plate 150 can be reduced in size. Thus, cost required for base plate 150 can be reduced.

First Modification of Second Exemplary Embodiment

Next, wireless module 201 according to a first modification of the second exemplary embodiment will be described.

Wireless module 201 according to the present modification has substantially the same configuration as wireless module 1 described in the first exemplary embodiment. However, wireless module 201 described in the present modification is different from wireless module 1 according to the first exemplary embodiment in the configuration of the short-circuit point at which the base plate and the ground pattern are short-circuited to each other. Hereinafter, with regard to wireless module 201 according to the present modification, a description of the matters described in the first exemplary embodiment will be omitted as appropriate, and points of difference from wireless module 1 according to the first exemplary embodiment will be mainly described. Note that constituent elements substantially the same as the constituent elements included in wireless module 1 described in the first exemplary embodiment are denoted by the same reference numerals, and a description thereof is omitted or simplified.

[2A-1. Configuration]

First, a configuration of wireless module 201 in the present modification will be described with reference to the drawings.

Figure 5A:
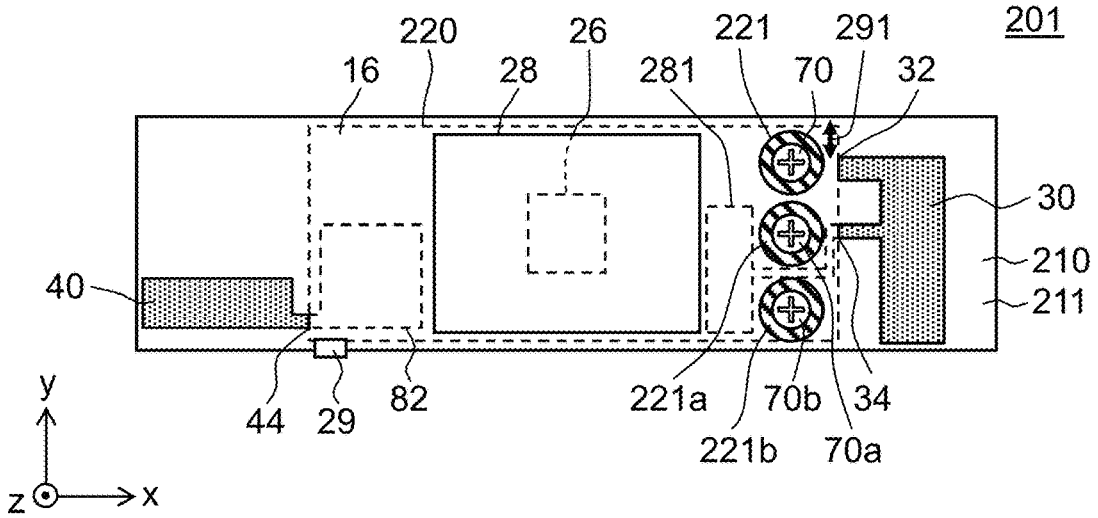
FIG. 5A is a top view schematically showing an example of an external appearance of a wireless module in a first modification of the second exemplary embodiment.

FIG. 5A is a top view schematically showing an example of an external appearance of wireless module 201 in the first modification of the second exemplary embodiment.

Figure 5B:
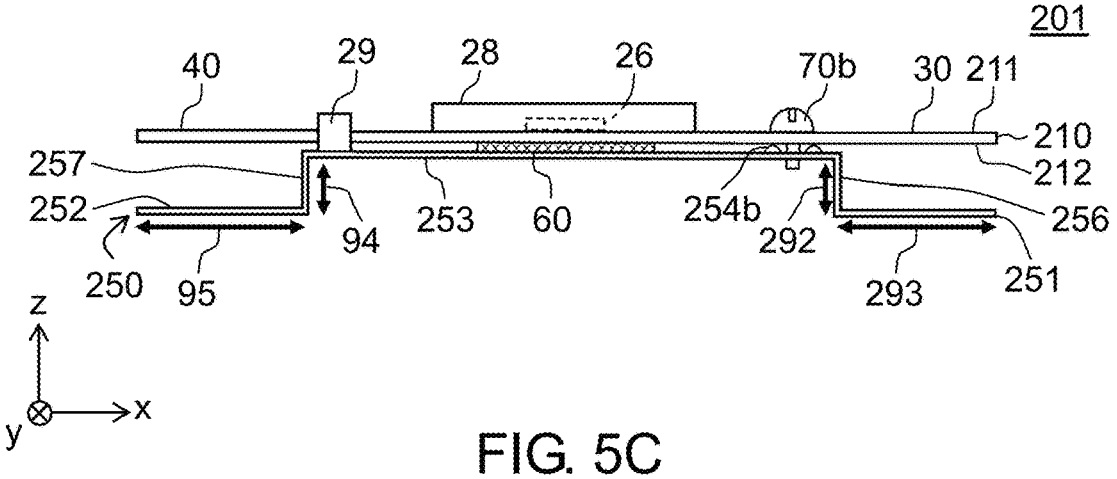
FIG. 5B is a side view schematically showing the example of the external appearance of the wireless module in the first modification of the second exemplary embodiment.

FIG. 5B is a side view schematically showing the example of the external appearance of wireless module 201 in the first modification of the second exemplary embodiment.

Figure 5C:
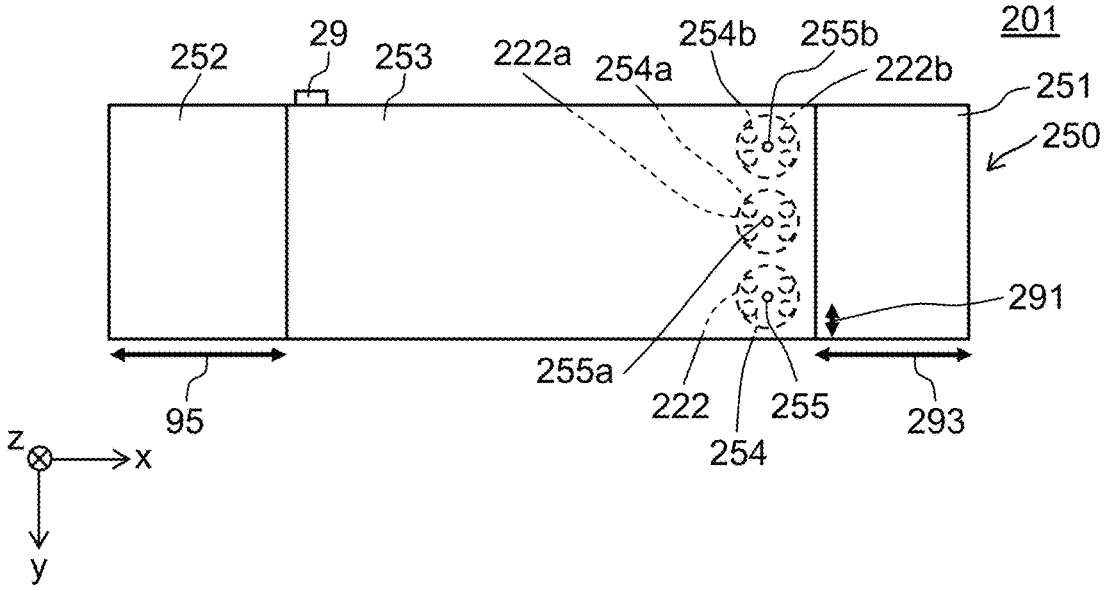
FIG. 5C is a bottom view schematically showing the example of the external appearance of the wireless module in the first modification of the second exemplary embodiment.

FIG. 5C is a bottom view schematically showing the example of the external appearance of wireless module 201 in the first modification of the second exemplary embodiment.

Figure 6:
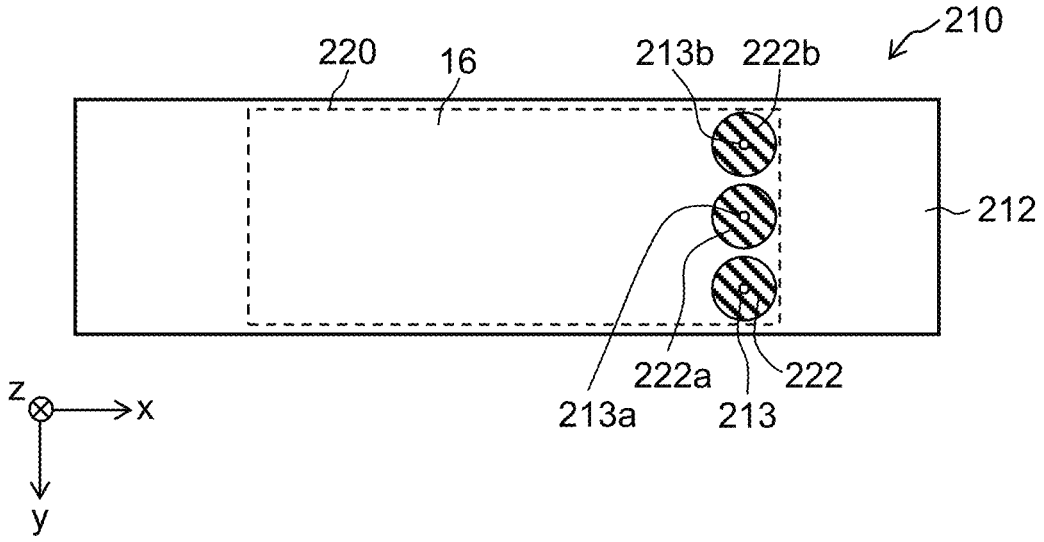
FIG. 6 is a bottom view schematically showing an example of an external appearance of a substrate of the wireless module in the first modification of the second exemplary embodiment.

FIG. 6 is a bottom view schematically showing an example of an external appearance of substrate 210 of wireless module 201 in the first modification of the second exemplary embodiment.

As shown in FIG. 5A, wireless module 201 includes substrate 210, ground patterns 220, IC 26, shield case 28, first antenna 30, second antenna 40, first matching circuit 281, second matching circuit 82, spacer 29, conductive screw 70, conductive screw 70*a*, and conductive screw 70*b*. Moreover, as shown in FIG. 5B, wireless module 201 further includes base plate 250 and heat conducting member 60.

As shown in FIG. 5A, ground pattern 220 includes exposed portion 221, exposed portion 221*a*, and exposed portion 221*b*, which are provided on first main surface 211 of substrate 210. Moreover, as shown in FIG. 6, ground pattern 220 further includes exposed portion 222, exposed portion 222*a*, and exposed portion 222*b*, which are provided on second main surface 212 of substrate 210. Exposed portion 221, exposed portion 221*a*, exposed portion 221*b*, exposed portion 222, exposed portion 222*a*, and exposed portion 222*b* are portions, which are not covered with resist 16 and exposed to the outside, in ground patterns 220. Exposed portion 221 and exposed portion 222 are disposed at positions facing each other. Exposed portion 221*a* and exposed portion 222*a* are disposed at positions facing each other. Exposed portion 221*b* and exposed portion 222*b* are disposed at positions facing each other. In the present modification, exposed portion 221, exposed portion 221*a*, and exposed portion 221*b*, and exposed portion 222, exposed portion 222*a*, and exposed portion 222*b* are arrayed in the width direction (y-axis direction) of substrate 210.

As shown in FIG. 5B, substrate 210 has first main surface 211 on which first antenna 30 and second antenna 40 are formed, and second main surface 212 opposite to first main surface 211. Further, as shown in FIG. 6, on substrate 210, through hole 213 is formed in centers of exposed portion 221 and exposed portion 222 of ground patterns 220, through hole 213*a* is formed in centers of exposed portion 221*a* and exposed portion 222*a*, and through hole 213*b* is formed in centers of exposed portion 221*b* and exposed portion 222*b*.

First matching circuit 281 is a circuit substantially the same as first matching circuit 81 according to the first exemplary embodiment. However, the layout of first matching circuit 281 on substrate 210 is different from the layout of first matching circuit 81 on substrate 10 in the first exemplary embodiment. On substrate 210, first matching circuit 281 is disposed at a position not interfering with the positions where the exposed portions of ground pattern 220 are disposed. Further, a position of an output unit of first matching circuit 281 is set according to the position where first power feeding part 34 of first antenna 30 is disposed.

Base plate 250 includes first opposed portion 251, second opposed portion 252, third opposed portion 253, first gap formation portion 256, and second gap formation portion 257 (see FIG. 5B), as in base plate 50 described in the first exemplary embodiment. Base plate 250 also has, on third opposed portion 253, short-circuit points at which base plate 250 and ground patterns 220 are short-circuited to each other. The short-circuit points are disposed on third opposed portion 253 at positions nearer to first opposed portion 251 than to second opposed portion 252.

As shown in FIG. 5C, base plate 250 includes one or a plurality (for example, four) of protrusions 254 at a position corresponding to exposed portion 222 of ground pattern 220, one or a plurality (for example, four) of protrusions 254*a* at a position corresponding to exposed portion 222*a*, and one or a plurality (for example, four) of protrusions 254*b* at a position corresponding to exposed portion 222*b*. Protrusions 254 are disposed to be in contact with exposed portion 222, protrusions 254*a* are disposed to be in contact with exposed portion 222*a*, and protrusions 254*b* are disposed to be in contact with exposed portion 222*b*, respectively. Further, as shown in FIG. 5C, in base plate 250, threaded hole 255 is formed at a position corresponding to through hole 213, threaded hole 255*a* is formed at a position corresponding to through hole 213*a*, and threaded hole 255*b* is formed at a position corresponding to through hole 213*b*. A threaded portion of conductive screw 70 that penetrates through hole 213 from first main surface 211 of substrate 210 is screwed into threaded hole 255, a threaded portion of conductive screw 70*a* that penetrates through hole 213*a* from first main surface 211 of substrate 210 is screwed into threaded hole 255*a*, and a threaded portion of conductive screw 70*b* that penetrates through hole 213*b* from first main surface 211 of substrate 210 is screwed into threaded hole 255*b*. Thus, base plate 250 is fixed to substrate 210 and short-circuited to exposed portion 221, exposed portion 221*a*, and exposed portion 221*b* of ground pattern 220 via conductive screw 70, conductive screw 70*a*, and conductive screw 70*b*. Further, exposed portion 222 and protrusions 254 are short-circuited, exposed portion 222*a* and protrusions 254*a* are short-circuited, and exposed portion 222*b* and protrusions 254*b* are short-circuited. Accordingly, in wireless module 201 in the present modification, protrusions 254, protrusions 254*a*, protrusions 254*b*, threaded hole 255, threaded hole 255*a*, and threaded hole 255*b* in base plate 250 constitute short-circuit points at which base plate 250 and ground patterns 220 are short-circuited to each other.

[2A-2. Configuration of Short-Circuit Point]

Next, the configuration of the short-circuit points according to the present modification will be described.

As described above, in wireless module 201 according to the present modification, the short-circuit points at which base plate 250 and ground patterns 220 are short-circuited to each other are formed at positions respectively corresponding to exposed portion 222, exposed portion 222*a*, and exposed portion 222*b* of ground pattern 220, and these short-circuit points are arrayed in the width direction (y-axis direction) of base plate 250. As described above, a number and position of the short-circuit points on wireless module 201 may be adjusted as appropriate. Thus, an electrical length from the short-circuit point, at which base plate 250 and ground patterns 220 are short-circuited to each other, to an edge of base plate 250 closest to the short-circuit point can be set to a desired length.

In wireless module 201 in the present modification, an electrical length from the short-circuit point, at which base plate 250 and ground patterns 220 are short-circuited to each other, to a vertex of base plate 250 closest to the short-circuit point is also determined in the same manner as in wireless module 1 in the first exemplary embodiment. That is, when the electrical length is schematically represented, this length is defined as a sum of lengths of arrow 291 in FIG. 5C and arrows 292 and 293 in FIG. 5B. In wireless module 201 in the present modification, an electrical length from the short-circuit point, at which base plate 250 and ground patterns 220 are short-circuited to each other, to the vertex of base plate 250 closest to the short-circuit point is also approximately ¼ times the resonance wavelength of first antenna 30 as in wireless module 1 in the first exemplary embodiment.

Therefore, in the present modification, the length (distance indicated by arrow 292 in FIG. 5B) of first gap formation portion 256 of base plate 250 in the z-axis direction and the length (distance indicated by arrow 293 in FIGS. 5B and 5C) of first opposed portion 251 in the x-axis direction can be adjusted to desired lengths by setting the electrical length from the short-circuit point, at which base plate 250 and ground patterns 220 are short-circuited to each other, to the edge of base plate 250 closest to the short-circuit point to a desired length.

[2A-3. Effects and Others]

As described above, the wireless module according to the present modification has a configuration substantially the same as the configuration of the wireless module in the first exemplary embodiment, and can provide substantially the same effect.

Note that wireless module 201 is an example of the wireless module. Substrate 210 is an example of the substrate. Each of ground patterns 220 is an example of the ground pattern. Base plate 250 is an example of the base plate. First opposed portion 251 is an example of the first opposed portion. Second opposed portion 252 is an example of the second opposed portion. Third opposed portion 253 is an example of the third opposed portion.

In addition, in wireless module 201 according to the present modification, a number and position of short-circuit points at which base plate 250 and ground patterns 220 are short-circuited to each other are adjusted by adjusting the position and number of the exposed portions of ground patterns 220 and the position and number of protrusions 254 on base plate 250.

Thus, in wireless module 201, the electrical length from the short-circuit point, at which base plate 250 and ground patterns 220 are short-circuited to each other, to the edge of base plate 250 closest to the short-circuit point can be set to a desired length. Accordingly, in wireless module 201, when the electrical length from the short-circuit point to the vertex of base plate 250 closest to the short-circuit point is set to be approximately ¼ times the resonance wavelength of first antenna 30, each of first gap formation portion 256 and first opposed portion 251 of base plate 250 can be adjusted to have a desired dimension.

Second Modification of Second Exemplary Embodiment

Next, wireless module 301 according to a second modification of the second exemplary embodiment will be described.

Wireless module 301 according to the present modification has substantially the same configuration as wireless module 1 described in the first exemplary embodiment. However, wireless module 301 described in the present modification is different from wireless module 1 according to the first exemplary embodiment in the configuration of short-circuit points at which the base plate and the ground pattern are short-circuited to each other. Hereinafter, with regard to wireless module 301 according to the present modification, a description of the matters described in the first exemplary embodiment will be omitted as appropriate, and points of difference from wireless module 1 according to the first exemplary embodiment will be mainly described. Note that constituent elements substantially the same as the constituent elements included in wireless module 1 described in the first exemplary embodiment are denoted by the same reference numerals, and a description thereof is omitted or simplified.

[2B-1. Configuration]

First, a configuration of wireless module 301 in the present modification will be described with reference to the drawings.

Figure 7A:
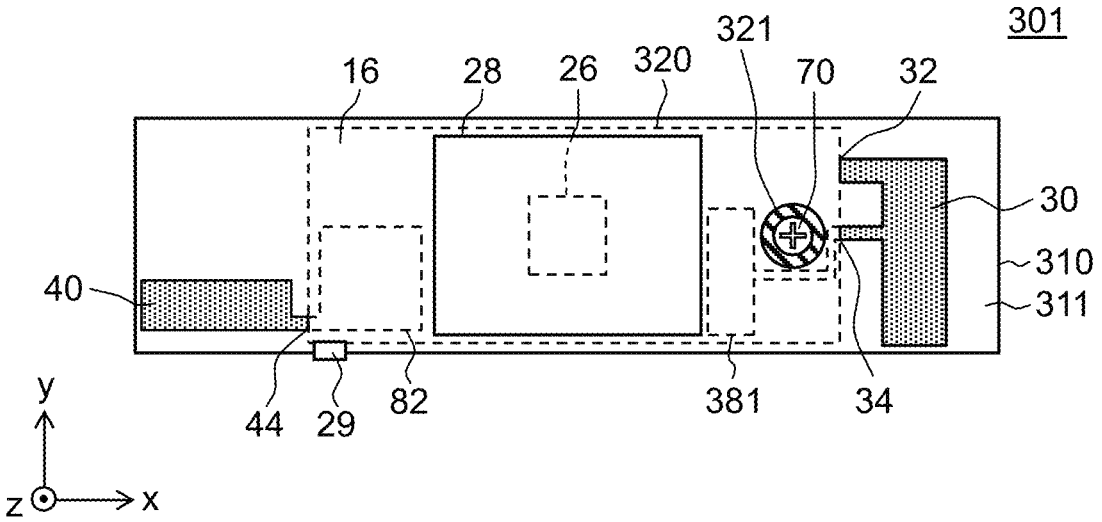
FIG. 7A is a top view schematically showing an example of an external appearance of a wireless module in a second modification of the second exemplary embodiment.

FIG. 7A is a top view schematically showing an example of an external appearance of wireless module 301 in the second modification of the second exemplary embodiment.

Figure 7B:
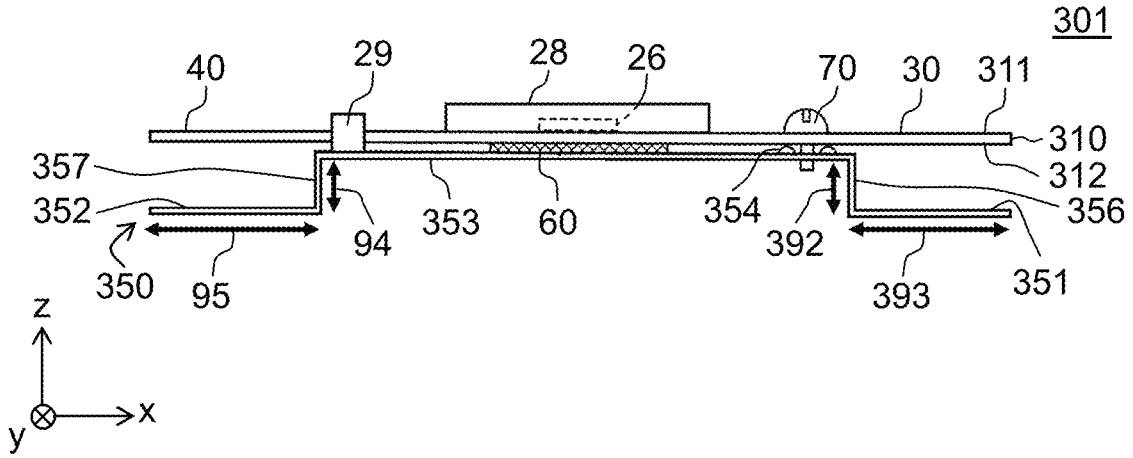
FIG. 7B is a side view schematically showing the example of the external appearance of the wireless module in the second modification of the second exemplary embodiment.

FIG. 7B is a side view schematically showing the example of the external appearance of wireless module 301 in the second modification of the second exemplary embodiment.

Figure 7C:
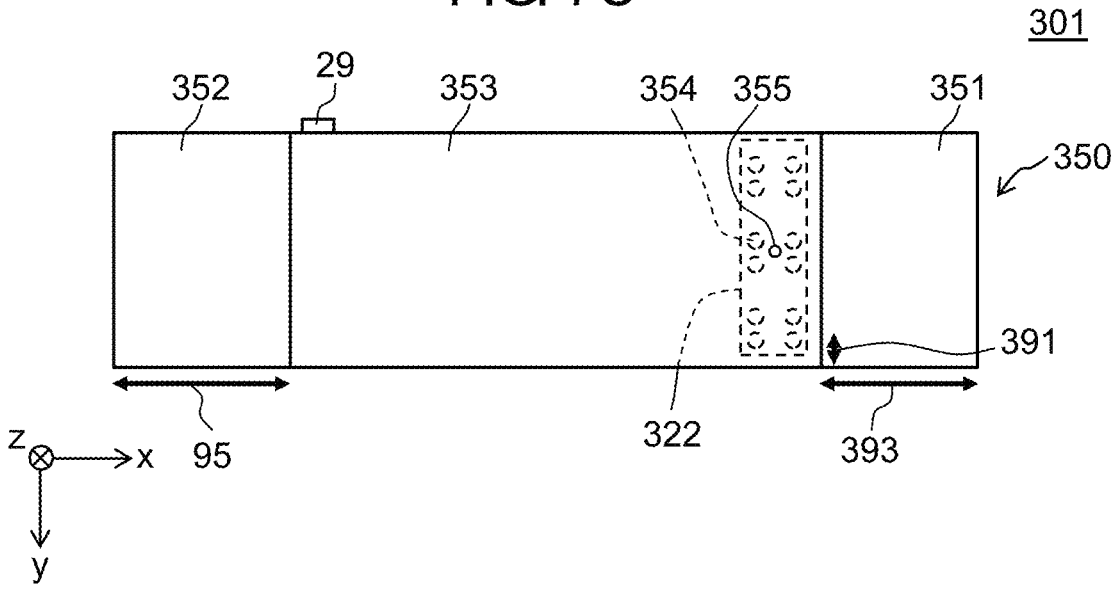
FIG. 7C is a bottom view schematically showing the example of the external appearance of the wireless module in the second modification of the second exemplary embodiment.

FIG. 7C is a bottom view schematically showing the example of the external appearance of wireless module 301 in the second modification of the second exemplary embodiment.

Figure 8:
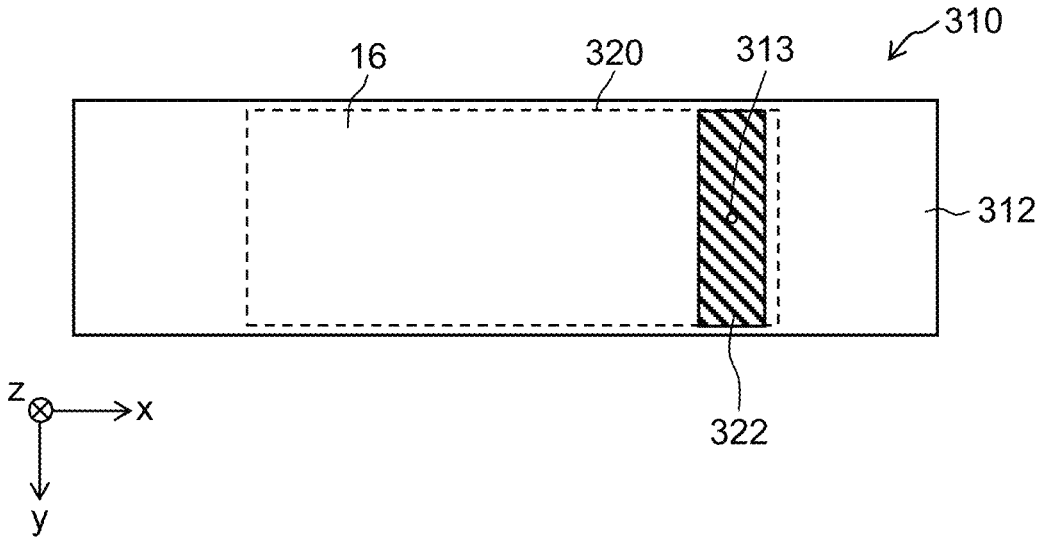
FIG. 8 is a bottom view schematically showing an example of an external appearance of a substrate of the wireless module in the second modification of the second exemplary embodiment.

FIG. 8 is a bottom view schematically showing an example of an external appearance of substrate 310 of wireless module 301 in the second modification of the second exemplary embodiment.

As shown in FIG. 7A, wireless module 301 includes substrate 310, ground patterns 320, IC 26, shield case 28, first antenna 30, second antenna 40, first matching circuit 381, second matching circuit 82, and spacer 29. Wireless module 301 further includes base plate 350, conductive screw 70, and heat conducting member 60, as shown in FIG. 7B.

As shown in FIG. 7A, ground pattern 320 includes exposed portion 321 provided on first main surface 311 of substrate 310. Moreover, as shown in FIG. 8, ground pattern 320 further includes exposed portion 322 provided on second main surface 312 of substrate 310. Exposed portion 321 and exposed portion 322 are portions, which are not covered with resist 16 and exposed to the outside, in ground patterns 320. In the present modification, exposed portion 322 has a rectangular shape extending in the width direction (y-axis direction) of substrate 310. In addition, exposed portion 322 is disposed at a position including an area facing exposed portion 321.

As shown in FIG. 7B, substrate 310 has first main surface 311 on which first antenna 30 and second antenna 40 are formed, and second main surface 312 opposite to first main surface 311. Further, as shown in FIG. 8, through hole 313 is formed in the center of exposed portion 322 of ground pattern 320 on substrate 310.

First matching circuit 381 is a circuit substantially the same as first matching circuit 81 according to the first exemplary embodiment. However, the layout of first matching circuit 381 on substrate 310 is different from the layout of first matching circuit 81 on substrate 10 in the first exemplary embodiment. On substrate 310, first matching circuit 381 is disposed at a position not interfering with the position where exposed portion 321 of ground pattern 320 is disposed. Further, a position of an output unit of first matching circuit 381 is set according to the position where first power feeding part 34 of first antenna 30 is disposed.

Base plate 350 includes first opposed portion 351, second opposed portion 352, third opposed portion 353, first gap formation portion 356, and second gap formation portion 357 (see FIG. 7B), as in base plate 50 described in the first exemplary embodiment. Base plate 350 also has, on third opposed portion 353, short-circuit points at which base plate 350 and ground patterns 320 are short-circuited to each other. The short-circuit points are disposed on third opposed portion 353 at positions nearer to first opposed portion 351 than to second opposed portion 352.

As shown in FIG. 7C, base plate 350 also includes one or a plurality of protrusions 354 at a position corresponding to exposed portion 322 of ground pattern 320. Protrusions 354 are disposed to be in contact with exposed portion 322. A number of protrusions 354 is not particularly limited. In the present modification, the number of protrusions 354 on base plate 350 is twelve. Moreover, as shown in FIG. 7C, threaded hole 355 is provided in base plate 350 at a position corresponding to through hole 313. A threaded portion of conductive screw 70 that penetrates through hole 313 from first main surface 311 of substrate 310 is screwed into threaded hole 355. In this way, base plate 350 is fixed to substrate 310 and is short-circuited to exposed portion 321 of ground pattern 320 via conductive screw 70. Further, exposed portion 322 and protrusions 354 are short-circuited. Thus, in wireless module 301 according to the present modification, protrusions 354 and threaded hole 355 of base plate 350 constitute short-circuit points at which base plate 350 and ground patterns 320 are short-circuited to each other.

[2B-2. Configuration of Short-Circuit Point]

Next, the configuration of the short-circuit points according to the present modification will be described.

As described above, in wireless module 301 according to the present modification, exposed portion 322 in ground pattern 320 has a rectangular shape extending along the width direction (y-axis direction) of substrate 310. Moreover, base plate 350 includes protrusions 354 at positions corresponding to exposed portion 322. As described above, the shape of exposed portion 322 and the shape (the arrangement position and number of protrusions 354) of base plate 350 may be adjusted as appropriate.

In wireless module 301 in the present modification, an electrical length from the short-circuit point, at which base plate 350 and ground patterns 320 are short-circuited to each other, to a vertex of base plate 350 closest to the short-circuit point is also determined in the same manner as in wireless module 1 in the first exemplary embodiment. That is, when the electrical length is schematically represented, this length is defined as a sum of lengths of arrow 391 in FIG. 7C and arrows 392 and 393 in FIG. 7B. Further, in wireless module 301 in the present modification, an electrical length from the short-circuit point, at which base plate 350 and ground patterns 320 are short-circuited to each other, to the vertex of base plate 350 closest to the short-circuit point is also approximately ¼ times the resonance wavelength of first antenna 30 as in wireless module 1 in the first exemplary embodiment.

Therefore, in the present modification, the length (distance indicated by arrow 392 in FIG. 7B) of first gap formation portion 356 of base plate 350 in the z-axis direction and the length (distance indicated by arrow 393 in FIGS. 7B and 7C) of first opposed portion 351 in the x-axis direction can be adjusted to desired lengths by setting the electrical length from the short-circuit point, at which base plate 350 and ground patterns 320 are short-circuited to each other, to the edge of base plate 350 closest to the short-circuit point to a desired length.

[2B-3. Effects and Others]

As described above, the wireless module according to the present modification has a configuration substantially the same as the configuration of the wireless module in the first exemplary embodiment, and can provide substantially the same effect.

Note that wireless module 301 is an example of the wireless module. Substrate 310 is an example of the substrate. Each of ground patterns 320 is an example of the ground pattern. Base plate 350 is an example of the base plate. First opposed portion 351 is an example of the first opposed portion. Second opposed portion 352 is an example of the second opposed portion. Third opposed portion 353 is an example of the third opposed portion.

In addition, in wireless module 301 according to the present modification, a number and position of short-circuit points at which base plate 350 and ground patterns 320 are short-circuited to each other are adjusted by adjusting the shape of exposed portion 322 of ground pattern 320 and the number of protrusions 354 on base plate 350.

Thus, in wireless module 301, the electrical length from the short-circuit point, at which base plate 350 and ground patterns 320 are short-circuited to each other, to the edge of base plate 350 closest to the short-circuit point can be set to a desired length. Accordingly, in wireless module 301, when the electrical length from the short-circuit point to the vertex of base plate 350 closest to the short-circuit point is set to be approximately ¼ times the resonance wavelength of first antenna 30, each of first gap formation portion 356 and first opposed portion 351 of base plate 350 can be adjusted to have a desired dimension.

Third Exemplary Embodiment

Next, wireless module 401 according to a third exemplary embodiment will be described.

Wireless module 401 according to the present exemplary embodiment has substantially the same configuration as wireless module 101 described in the second exemplary embodiment. However, wireless module 401 described in the present exemplary embodiment is different in a shape of the base plate from wireless module 101 according to the second exemplary embodiment. Hereinafter, with regard to wireless module 401 according to the present exemplary embodiment, a description of the matters described in the first and second exemplary embodiments will be omitted as appropriate, and points of difference from wireless module 101 according to the second exemplary embodiment will be mainly described. Note that constituent elements substantially the same as the constituent elements included in wireless module 101 described in the second exemplary embodiment are denoted by the same reference numerals, and a description thereof is omitted or simplified.

[3-1. Configuration]

First, a configuration of wireless module 401 in the present exemplary embodiment will be described with reference to the drawings.

Figure 9A:
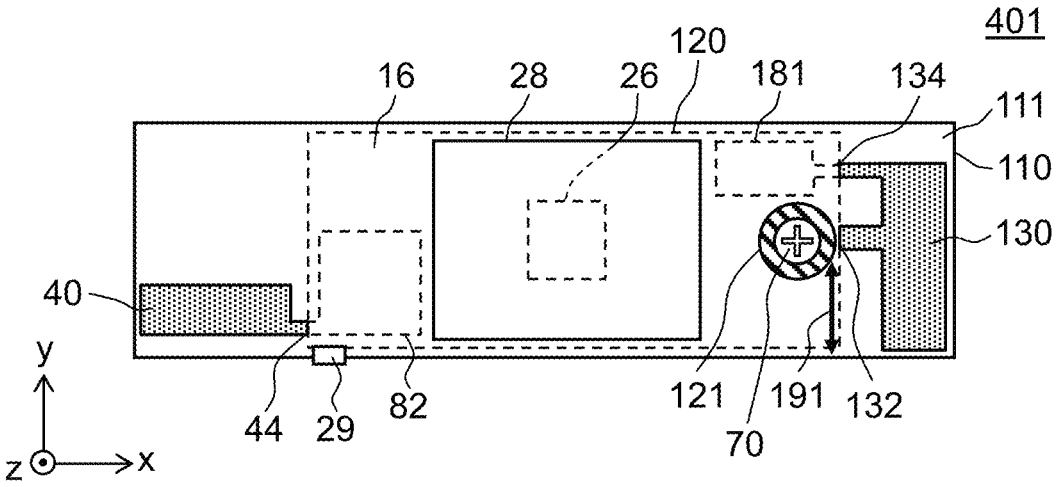
FIG. 9A is a top view schematically showing an example of an external appearance of a wireless module in a third exemplary embodiment.

FIG. 9A is a top view schematically showing an example of an external appearance of wireless module 401 in the third exemplary embodiment.

Figure 9B:
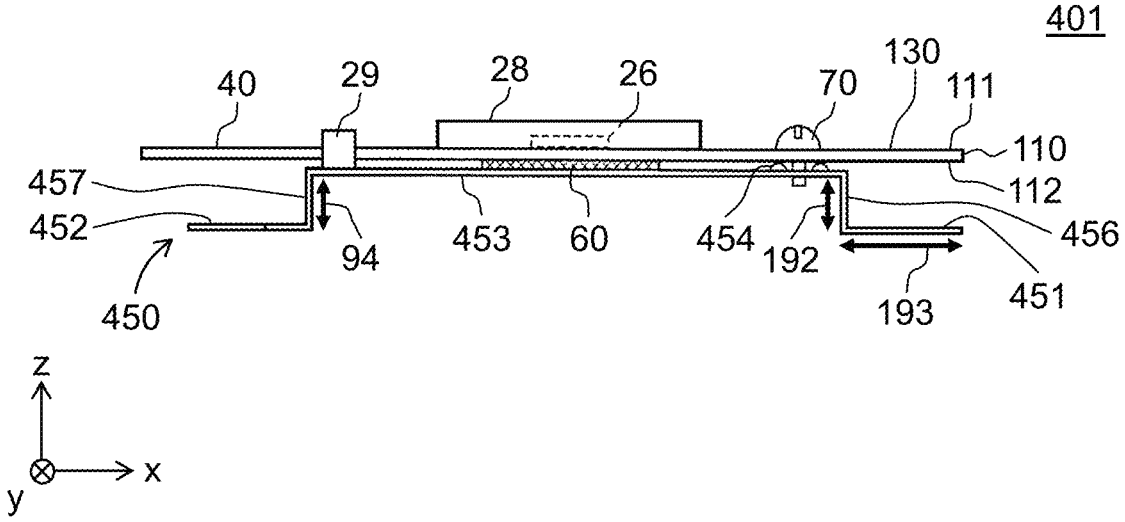
FIG. 9B is a side view schematically showing the example of the external appearance of the wireless module in the third exemplary embodiment.

FIG. 9B is a side view schematically showing the example of the external appearance of wireless module 401 in the third exemplary embodiment.

Figure 10:
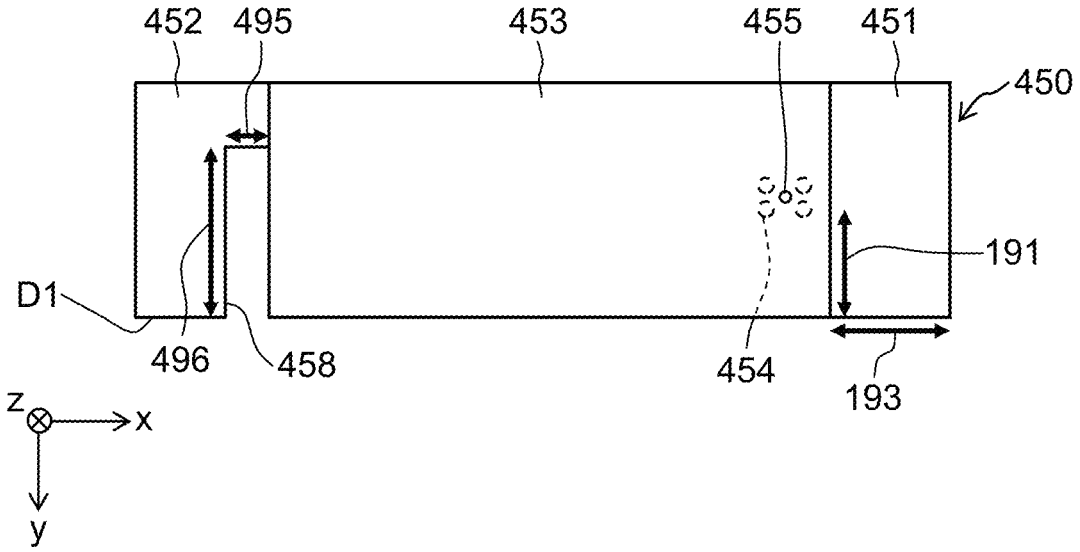
FIG. 10 is a bottom view schematically showing an example of an external appearance of a base plate of the wireless module in the third exemplary embodiment.

FIG. 10 is a bottom view schematically showing an example of an external appearance of base plate 450 of wireless module 401 in the third exemplary embodiment.

As shown in FIG. 9A, wireless module 401 includes substrate 110, ground patterns 120, IC 26, shield case 28, first antenna 130, second antenna 40, first matching circuit 181, second matching circuit 82, and spacer 29. Wireless module 401 further includes base plate 450, conductive screw 70, and heat conducting member 60, as shown in FIG. 9B.

Base plate 450 includes first opposed portion 451, second opposed portion 452, third opposed portion 453, first gap formation portion 456, and second gap formation portion 457 (see FIG. 9B), as in base plate 150 described in the second exemplary embodiment. Base plate 450 also has, on third opposed portion 453, short-circuit points at which base plate 450 and ground patterns 120 are short-circuited to each other. The short-circuit points are disposed on third opposed portion 453 at positions nearer to first opposed portion 451 than to second opposed portion 452.

Base plate 450 includes one or a plurality (for example, four) of protrusions 454 as shown in FIG. 10. Protrusions 454 are provided to be in contact with exposed portion 122 (see FIG. 4) as in wireless module 101 described in the second exemplary embodiment. Further, as shown in FIG. 10, base plate 450 is formed with threaded hole 455 at a position corresponding to through hole 113 (see FIG. 4) formed in substrate 110 for passage of conductive screw 70. A threaded portion of conductive screw 70 that penetrates through hole 113 from first main surface 111 of substrate 110 is screwed into threaded hole 455. In this way, base plate 450 is fixed to substrate 110 and is short-circuited to exposed portion 121 of ground pattern 120 via conductive screw 70. Further, exposed portion 122 and protrusions 454 are short-circuited. Thus, in wireless module 401 according to the present exemplary embodiment, protrusions 454 and threaded hole 455 of base plate 450 constitute short-circuit points at which base plate 450 and ground patterns 120 are short-circuited to each other.

Further, as shown in FIG. 10, base plate 450 of wireless module 401 according to the present exemplary embodiment has, on an end of second opposed portion 452 closer to third opposed portion 453, cut 458 extending along an edge of this end.

In addition, in wireless module 401 in the present exemplary embodiment, an electrical length in base plate 450 from an end of third opposed portion 453 closer to second opposed portion 452 to an opposite end of second opposed portion 452 from third opposed portion 453 is also set to be approximately ¼ times the resonance wavelength of first antenna 130, as in the first and second exemplary embodiments. Thus, isolation between both antennas (first antenna 130 and second antenna 40) can be enhanced.

It is to be noted that, when cut 458 is formed in base plate 450 as in the present exemplary embodiment, the above-mentioned "opposite end of second opposed portion 452 from third opposed portion 453" is end D1 of second opposed portion 452 in the y-axis direction as shown in FIG. 10. In this case, when the electrical length is schematically represented, this length is represented as a sum of the length of an edge of second gap formation portion 457 indicated by arrow 94 in FIG. 9B, the width of cut 458 indicated by arrow 495 and the length of cut 458 indicated by arrow 496 in FIG. 10.

Therefore, in wireless module 401, due to cut 458 being formed in base plate 450, the dimension of second opposed portion 452 in the x-axis direction can be decreased, as compared to wireless module 1 in the first exemplary embodiment. That is, wireless module 401 can further be downsized in the present exemplary embodiment.

[3-2. Effects and Others]

As described above, the wireless module according to the present exemplary embodiment has a configuration substantially the same as the configuration of the wireless module in the second exemplary embodiment, and can provide substantially the same effect.

Note that wireless module 401 is an example of the wireless module. Base plate 450 is an example of the base plate. First opposed portion 451 is an example of the first opposed portion. Second opposed portion 452 is an example of the second opposed portion. Third opposed portion 453 is an example of the third opposed portion.

Further, in the wireless module, a cut may be formed at an end of the second opposed portion closer to the third opposed portion so as to extend along an edge of this end.

Note that cut 458 is an example of the cut.

For example, in the example described in the third exemplary embodiment, base plate 450 of wireless module 401 has, at an end of second opposed portion 452 closer to third opposed portion 453, cut 458 extending along an edge of this end.

With this configuration, in wireless module 401, in a case where an electrical length in base plate 450 from the end of third opposed portion 453 closer to second opposed portion 452 to the opposite end of second opposed portion 452 from third opposed portion 453 is set to be approximately ¼ times the resonance wavelength of first antenna 130, the dimension of second opposed portion 452 in the x-axis direction can be decreased as compared to a configuration where cut 458 is not formed. That is, wireless module 401 can further be downsized in the present exemplary embodiment.

Fourth Exemplary Embodiment

Next, wireless module 501 according to a fourth exemplary embodiment will be described.

Wireless module 501 according to this exemplary embodiment has substantially the same configuration as wireless module 101 described in the second exemplary embodiment. However, wireless module 501 described in the present exemplary embodiment is different from wireless module 101 according to the second exemplary embodiment in that a dielectric is interposed between the substrate and the base plate. Hereinafter, with regard to wireless module 501 according to the present exemplary embodiment, a description of the matters described in the first and second exemplary embodiments will be omitted as appropriate, and points of difference from wireless module 101 according to the second exemplary embodiment will be mainly described. Note that constituent elements substantially the same as the constituent elements included in wireless module 101 described in the second exemplary embodiment are denoted by the same reference numerals, and a description thereof is omitted or simplified.

[4-1. Configuration]

First, a configuration of wireless module 501 in the present exemplary embodiment will be described with reference to the drawings.

Figure 11A:
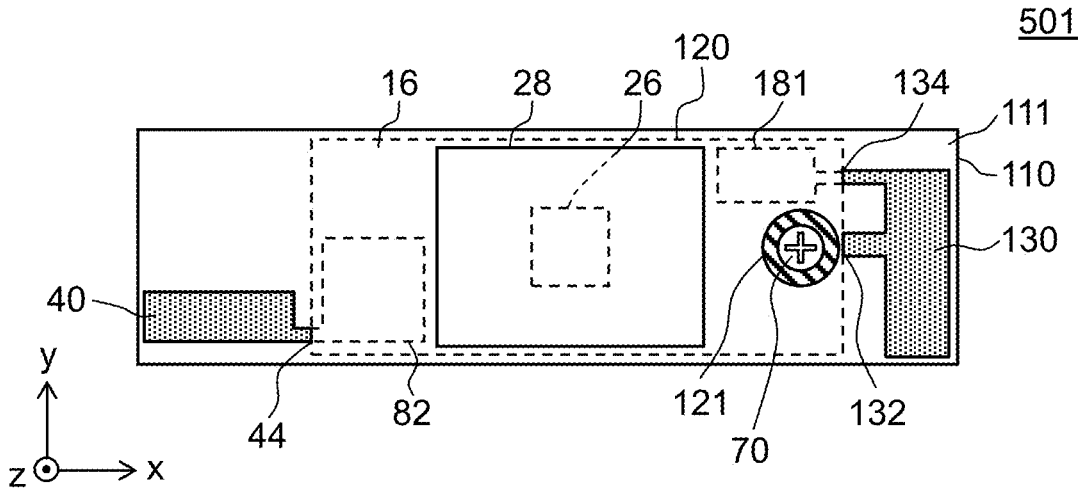
FIG. 11A is a top view schematically showing an example of an external appearance of a wireless module in a fourth exemplary embodiment.

FIG. 11A is a top view schematically showing an example of an external appearance of wireless module 501 in the fourth exemplary embodiment.

Figure 11B:
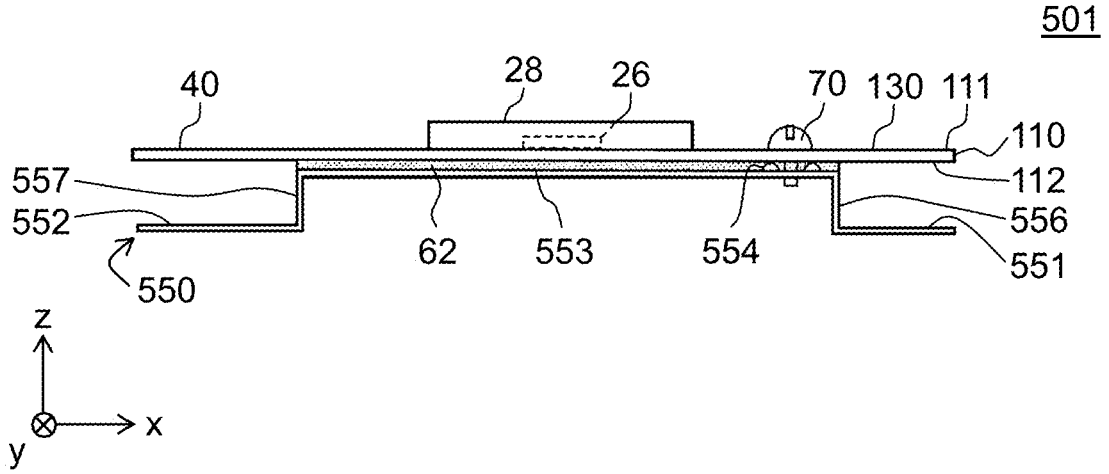
FIG. 11B is a side view schematically showing the example of the external appearance of the wireless module in the fourth exemplary embodiment.

FIG. 11B is a side view schematically showing the example of the external appearance of wireless module 501 in the fourth exemplary embodiment.

Figure 11C:
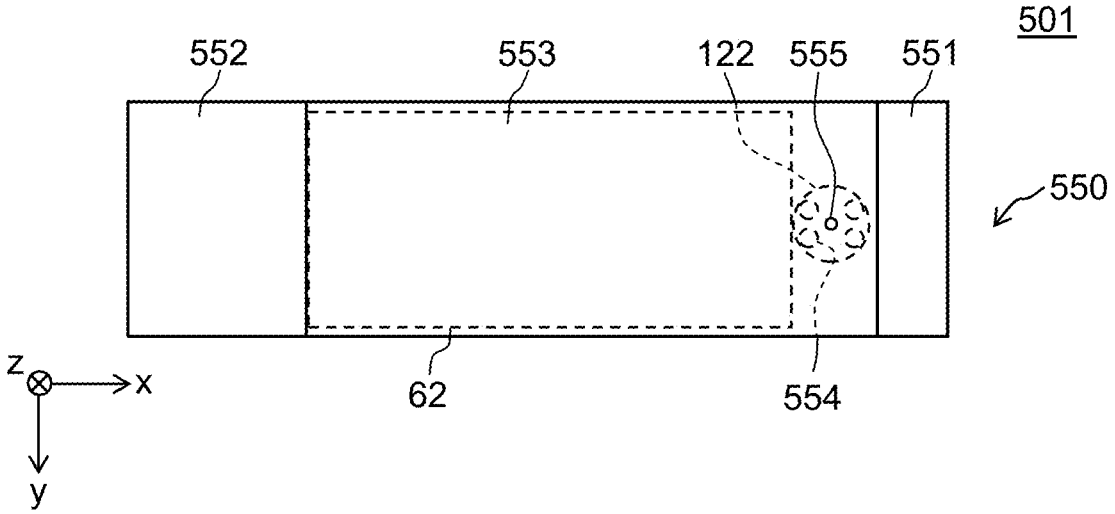
FIG. 11C is a bottom view schematically showing the example of the external appearance of the wireless module in the fourth exemplary embodiment.

FIG. 11C is a bottom view schematically showing the example of the external appearance of wireless module 501 in the fourth exemplary embodiment.

As shown in FIG. 11A, wireless module 501 includes substrate 110, ground patterns 120, IC 26, shield case 28, first antenna 130, second antenna 40, first matching circuit 181, and second matching circuit 82. Wireless module 501 further includes base plate 550, conductive screw 70, and dielectric 62, as shown in FIG. 11B.

Base plate 550 includes first opposed portion 551, second opposed portion 552, third opposed portion 553, first gap formation portion 556, and second gap formation portion 557 (see FIG. 11B), as in base plate 50 described in the first exemplary embodiment. Base plate 550 also has, on third opposed portion 553, short-circuit points at which base plate 550 and ground patterns 120 are short-circuited to each other. The short-circuit points are disposed on third opposed portion 553 at positions nearer to first opposed portion 551 than to second opposed portion 552.

Further, base plate 550 includes one or a plurality (for example, four) of protrusions 554 as shown in FIG. 11C. Protrusions 554 are provided to be in contact with exposed portion 122 (see FIG. 4) as in wireless module 101 described in the second exemplary embodiment. Moreover, as shown in FIG. 11C, base plate 550 is formed with threaded hole 555 at a position corresponding to through hole 113 (see FIG. 4) formed in substrate 110 for passage of conductive screw 70. A threaded portion of conductive screw 70 that penetrates through hole 113 from first main surface 111 of substrate 110 is screwed into threaded hole 555. In this way, base plate 550 is fixed to substrate 110 and is short-circuited to exposed portion 121 of ground pattern 120 via conductive screw 70. Further, exposed portion 122 and protrusions 554 are short-circuited. Thus, in wireless module 501 according to the present exemplary embodiment, protrusions 554 and threaded hole 555 of base plate 550 constitute short-circuit points at which base plate 550 and ground patterns 120 are short-circuited to each other.

Dielectric 62 is a dielectric disposed between substrate 110 and base plate 550. Dielectric 62 has a sheet shape and is disposed in an area other than the short-circuit points between substrate 110 and third opposed portion 553 of base plate 550. Due to dielectric 62, a dielectric constant between ground pattern 120 disposed on substrate 110 and base plate 550 can be adjusted. The dielectric constant affects isolation characteristics between both antennas (first antenna 130 and second antenna 40). Therefore, in wireless module 501, the isolation characteristics between both antennas can be adjusted by adjusting the dielectric constant. In wireless module 501, the isolation characteristics between both antennas can be enhanced by adjusting the dielectric constant, dimension, and other factors of dielectric 62 according to the dimension and other factors of base plate 550, for example.

[4-2. Effects and Others]

As described above, the wireless module according to the present exemplary embodiment has a configuration substantially the same as the configuration of the wireless module in the second exemplary embodiment, and can provide substantially the same effect.

Note that wireless module 501 is an example of the wireless module. Base plate 550 is an example of the base plate. First opposed portion 551 is an example of the first opposed portion. Second opposed portion 552 is an example of the second opposed portion. Third opposed portion 553 is an example of the third opposed portion.

The wireless module may further include a dielectric disposed between the substrate and the base plate.

Note that dielectric 62 is an example of the dielectric.

For example, in the example described in the fourth exemplary embodiment, wireless module 501 further includes dielectric 62 disposed between substrate 110 and base plate 550.

In wireless module 501, due to dielectric 62 being interposed between substrate 110 and base plate 550, the dielectric constant between ground pattern 120 disposed on substrate 110 and base plate 550 can be adjusted. In wireless module 501, the isolation characteristics between both antennas (first antenna 130 and second antenna 40) can be enhanced by adjusting the dielectric constant, dimension, and other factors of dielectric 62 according to the dimension and other factors of base plate 550, for example.

First Modification of Fourth Exemplary Embodiment

Next, wireless module 601 according to a first modification of the fourth exemplary embodiment will be described.

Wireless module 601 according to this modification has substantially the same configuration as wireless module 501 described in the fourth exemplary embodiment. However, wireless module 601 in the present modification is different from wireless module 501 according to the fourth exemplary embodiment in that a dielectric is interposed not only between the substrate and the third opposed portion but also between the substrate and the first opposed portion and between the substrate and the second opposed portion. Hereinafter, with regard to wireless module 601 according to the present modification, a description of the matters described in the first to fourth exemplary embodiments will be omitted as appropriate, and points of difference from wireless module 501 according to the fourth exemplary embodiment will be mainly described. Note that constituent elements substantially the same as the constituent elements included in wireless module 501 described in the fourth exemplary embodiment are denoted by the same reference numerals, and a description thereof is omitted or simplified.

[4A-1. Configuration]

First, a configuration of wireless module 601 in the present modification will be described with reference to the drawings.

Figure 12A:
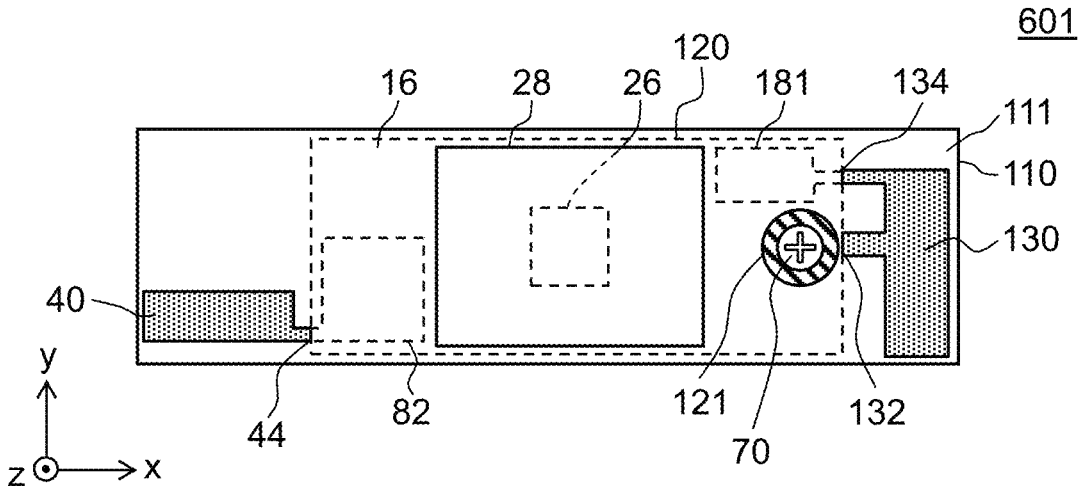
FIG. 12A is a top view schematically showing an example of an external appearance of a wireless module in a first modification of the fourth exemplary embodiment.

FIG. 12A is a top view schematically showing an example of an external appearance of wireless module 601 in the first modification of the fourth exemplary embodiment.

Figure 12B:
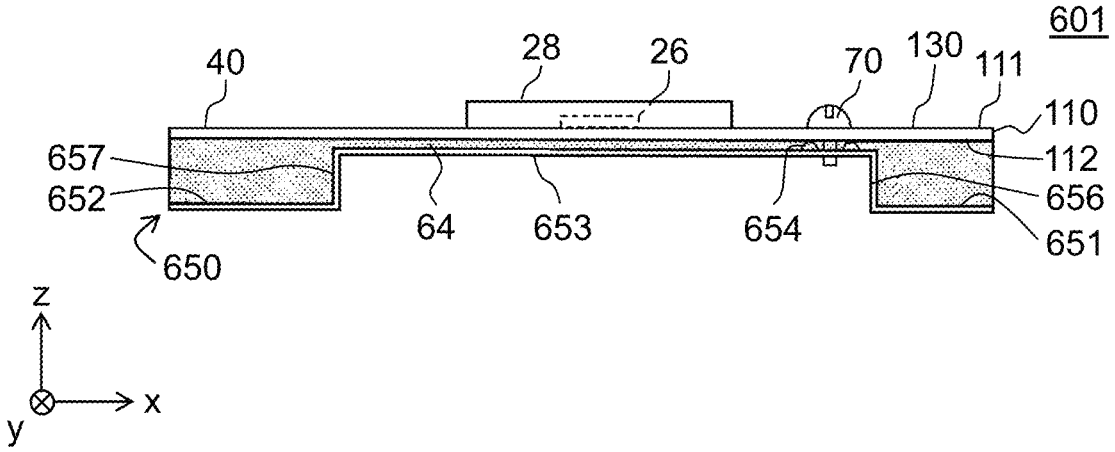
FIG. 12B is a side view schematically showing the example of the external appearance of the wireless module in the first modification of the fourth exemplary embodiment.

FIG. 12B is a side view schematically showing the example of the external appearance of wireless module 601 in the first modification of the fourth exemplary embodiment.

As shown in FIG. 12A, wireless module 601 includes substrate 110, ground patterns 120, IC 26, shield case 28, first antenna 130, second antenna 40, first matching circuit 181, and second matching circuit 82. Wireless module 601 further includes base plate 650, conductive screw 70, and dielectric 64, as shown in FIG. 12B.

Base plate 650 includes first opposed portion 651, second opposed portion 652, third opposed portion 653, first gap formation portion 656, and second gap formation portion 657 (see FIG. 12B), as in base plate 550 described in the fourth exemplary embodiment. Further, base plate 650 also has, on third opposed portion 653, short-circuit points at which base plate 650 and ground patterns 120 are short-circuited to each other. The short-circuit points are disposed on third opposed portion 653 at positions nearer to first opposed portion 651 than to second opposed portion 652.

Moreover, base plate 650 includes one or a plurality of protrusions 654 as shown in FIG. 12B. Protrusions 654 are provided to be in contact with exposed portion 122 (see FIG. 4) as in wireless module 101 described in the second exemplary embodiment. Further, base plate 650 is formed with a threaded hole (not shown) at a position corresponding to through hole 113 (see FIG. 4) formed in substrate 110 for passage of conductive screw 70. A threaded portion of conductive screw 70 that penetrates through hole 113 from first main surface 111 of substrate 110 is screwed into the threaded hole. In this way, base plate 650 is fixed to substrate 110 and is short-circuited to exposed portion 121 of ground pattern 120 via conductive screw 70. Further, exposed portion 122 and protrusions 654 are short-circuited. Thus, in wireless module 601 according to the present modification, protrusions 654 and the threaded hole of base plate 650 constitute short-circuit points at which base plate 650 and ground patterns 120 are short-circuited to each other.

Dielectric 64 is a dielectric disposed between substrate 110 and base plate 650. As shown in FIG. 12B, dielectric 64 is interposed almost entirely between substrate 110 and base plate 650 except for the short-circuit points. That is, dielectric 64 is interposed not only between substrate 110 and third opposed portion 653 but also between substrate 110 and first opposed portion 651 and between substrate 110 and second opposed portion 652.

In wireless module 601 in the present modification, due to dielectric 64 described above, the dielectric constant between ground pattern 120 disposed on substrate 110 and base plate 650 can be adjusted, as in dielectric 62 in wireless module 501 according to the fourth exemplary embodiment. In wireless module 601, the isolation characteristics between both antennas (first antenna 130 and second antenna 40) can be adjusted by adjusting the dielectric constant. In wireless module 601, the isolation characteristics between both antennas can be enhanced by adjusting the dielectric constant, dimension, and other factors of dielectric 64 according to the dimension and other factors of base plate 650, for example.

Note that, in wireless module 601 in the present modification, base plate 650 may be formed of, for example, thin metal, such as copper foil, disposed on dielectric 64.

[4A-2. Effects and Others]

As described above, the wireless module according to the present modification has a configuration substantially the same as the configuration of the wireless module in the fourth exemplary embodiment, and can provide substantially the same effect.

Note that wireless module 601 is an example of the wireless module. Base plate 650 is an example of the base plate. First opposed portion 651 is an example of the first opposed portion. Second opposed portion 652 is an example of the second opposed portion. Third opposed portion 653 is an example of the third opposed portion. Dielectric 64 is an example of the dielectric.

In the example described in the present modification, wireless module 601 further includes dielectric 64 disposed between substrate 110 and base plate 650. Dielectric 64 is interposed not only between substrate 110 and third opposed portion 653 but also between substrate 110 and first opposed portion 651 and between substrate 110 and second opposed portion 652.

In wireless module 601, due to dielectric 64 being interposed between substrate 110 and base plate 650, the dielectric constant between ground pattern 120 disposed on substrate 110 and base plate 650 can be adjusted. In wireless module 601, the isolation characteristics between both antennas (first antenna 130 and second antenna 40) can be enhanced by adjusting the dielectric constant, dimension, and other factors of dielectric 64 according to the dimension and other factors of base plate 650, for example.

In addition, in wireless module 601, base plate 650 may be formed of, for example, thin metal, such as copper foil, disposed on dielectric 64.

Second Modification of Fourth Exemplary Embodiment

Next, wireless module 701 according to a second modification of the fourth exemplary embodiment will be described.

Wireless module 701 according to the present modification has substantially the same configuration as wireless module 601 described in the first modification of the fourth exemplary embodiment. However, wireless module 701 described in the present modification is different from wireless module 601 according to the first modification of the fourth exemplary embodiment in that the base plate includes a reactance element. Hereinafter, with regard to wireless module 701 according to the present modification, a description of the matters described in the first to fourth exemplary embodiments and the first modification of the fourth exemplary embodiment will be omitted as appropriate, and points of difference from wireless module 601 according to the first modification of the fourth exemplary embodiment will be mainly described. Note that constituent elements substantially the same as the constituent elements included in wireless module 601 described in the first modification of the fourth exemplary embodiment are denoted by the same reference numerals, and a description thereof is omitted or simplified.

[4B-1. Configuration]

First, a configuration of wireless module 701 in the present modification will be described with reference to the drawings.

Figure 13A:
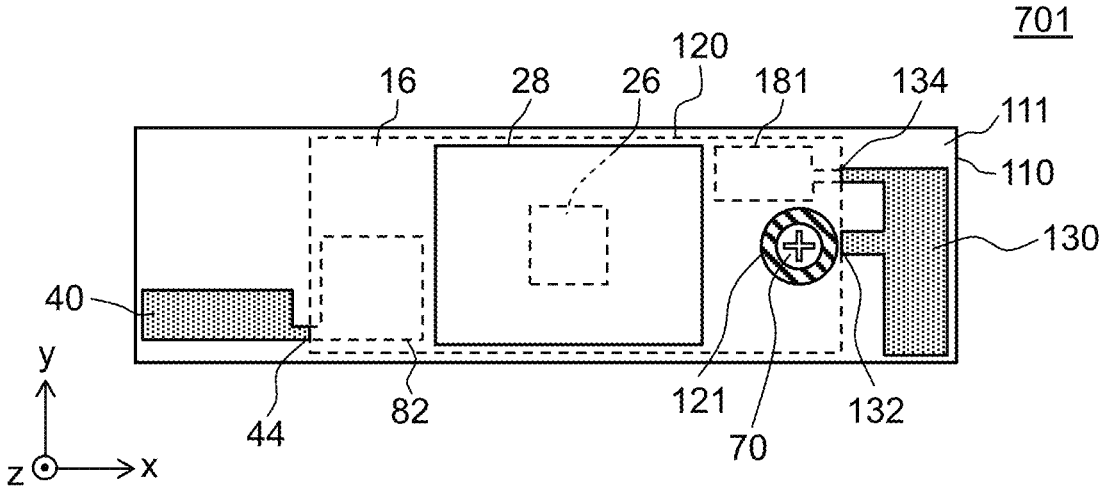
FIG. 13A is a top view schematically showing an example of an external appearance of a wireless module in a second modification of the fourth exemplary embodiment.

FIG. 13A is a top view schematically showing an example of an external appearance of wireless module 701 in the second modification of the fourth exemplary embodiment.

Figure 13B:
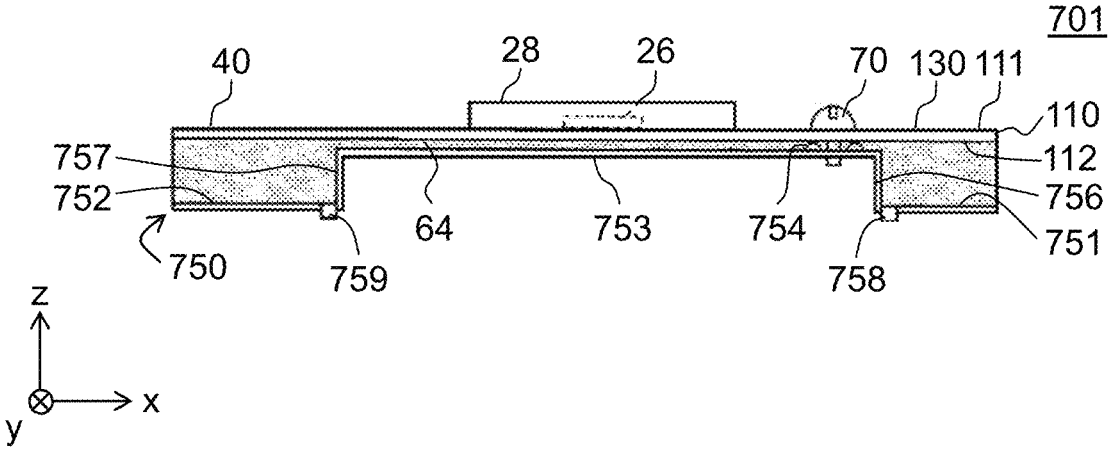
FIG. 13B is a side view schematically showing the example of the external appearance of the wireless module in the second modification of the fourth exemplary embodiment.

FIG. 13B is a side view schematically showing the example of the external appearance of wireless module 701 in the second modification of the fourth exemplary embodiment.

Figure 14:
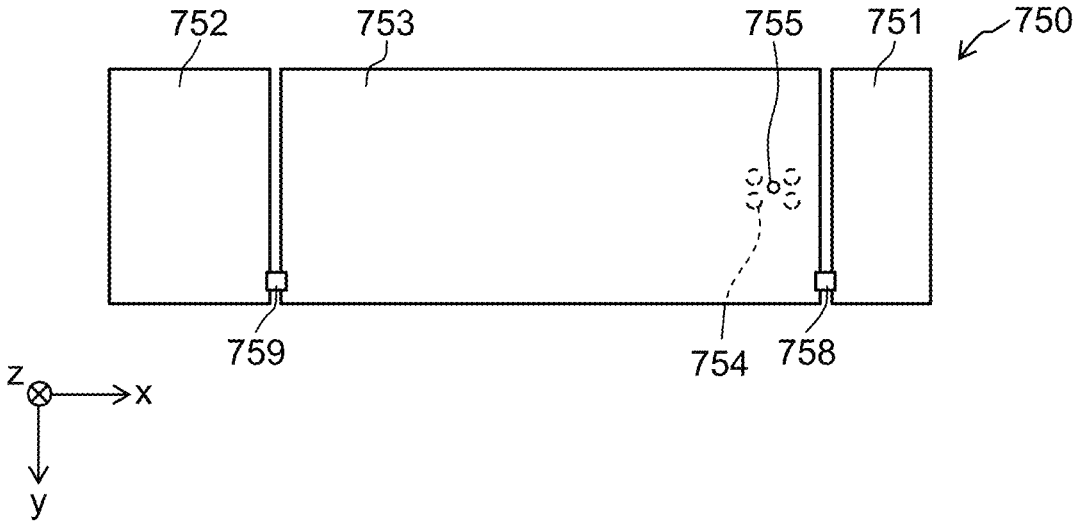
FIG. 14 is a bottom view schematically showing an example of an external appearance of a base plate of the wireless module in the second modification of the fourth exemplary embodiment.

FIG. 14 is a bottom view schematically showing an example of an external appearance of base plate 750 of wireless module 701 in the second modification of the fourth exemplary embodiment.

As shown in FIG. 13A, wireless module 701 includes substrate 110, ground patterns 120, IC 26, shield case 28, first antenna 130, second antenna 40, first matching circuit 181, and second matching circuit 82. Wireless module 701 further includes base plate 750, conductive screw 70, and dielectric 64, as shown in FIG. 13B.

Base plate 750 includes first opposed portion 751, second opposed portion 752, third opposed portion 753, first gap formation portion 756, and second gap formation portion 757 (see FIG. 13B), as in base plate 650 described in the first modification of the fourth exemplary embodiment. Base plate 750 also has, on third opposed portion 753, short-circuit points at which base plate 750 and ground patterns 120 are short-circuited to each other. The short-circuit points are disposed on third opposed portion 753 at positions nearer to first opposed portion 751 than to second opposed portion 752.

Further, base plate 750 includes one or a plurality (for example, four) of protrusions 754 as shown in FIG. 14. Protrusions 754 are provided to be in contact with exposed portion 122 (see FIG. 4) as in wireless module 101 described in the second exemplary embodiment. Further, base plate 750 is formed with threaded hole 755 at a position corresponding to through hole 113 (see FIG. 4) formed in substrate 110 for passage of conductive screw 70. A threaded portion of conductive screw 70 that penetrates through hole 113 from first main surface 111 of substrate 110 is screwed into threaded hole 755. In this way, base plate 750 is fixed to substrate 110 and is short-circuited to exposed portion 121 of ground pattern 120 via conductive screw 70. Further, exposed portion 122 and protrusions 754 are short-circuited. Thus, in wireless module 701 according to the present modification, protrusions 754 and threaded hole 755 of base plate 750 constitute short-circuit points at which base plate 750 and ground patterns 120 are short-circuited to each other.

Wireless module 701 according to the present modification further includes reactance element 758 and reactance element 759 at base plate 750. As shown in FIGS. 13B and 14, reactance element 758 is an element connecting first opposed portion 751 and first gap formation portion 756. As shown in FIGS. 13B and 14, reactance element 759 is an element connecting second opposed portion 752 and second gap formation portion 757.

In wireless module 701 in the present modification, an effective electrical length from the short-circuit point, at which base plate 750 and ground patterns 120 are short-circuited to each other, to a vertex of base plate 750 closest to the short-circuit point can be adjusted with reactance element 758. That is, in wireless module 701, the effective electrical length can be adjusted without changing the physical dimension of base plate 750. Similarly, in wireless module 701 according to the present modification, an effective electrical length in base plate 750 from an end of third opposed portion 753 closer to second opposed portion 752 to an opposite end of second opposed portion 752 from third opposed portion 753 can be adjusted with reactance element 759.

Specifically, in wireless module 701, when an inductor is used as reactance element 758 and reactance element 759, the effective electrical lengths can be set longer than a physical length determined by the dimension of base plate 750. Alternatively, in wireless module 701, when a capacitor is used as reactance element 758 and reactance element 759, the effective electrical lengths can be set shorter than the physical length determined by the dimension of base plate 750.

[4B-2. Effects and Others]

As described above, the wireless module according to the present modification has a configuration substantially the same as the configuration of the wireless module in the first modification of the fourth exemplary embodiment, and can provide substantially the same effect.

Note that wireless module 701 is an example of the wireless module. Base plate 750 is an example of the base plate. First opposed portion 751 is an example of the first opposed portion. Second opposed portion 752 is an example of the second opposed portion. Third opposed portion 753 is an example of the third opposed portion.

In the example shown in the present modification, wireless module 701 includes reactance element 758 and reactance element 759 at base plate 750.

With this configuration, in wireless module 701, an effective electrical length in base plate 750 can be adjusted. That is, in wireless module 701, the effective electrical length can be adjusted without changing the physical dimension of base plate 750. In wireless module 701, the isolation characteristics between both antennas (first antenna 130 and second antenna 40) can be enhanced by adjusting the properties of reactance element 758 and reactance element 759 according to the dimension and other factors of base plate 750, for example.

Fifth Exemplary Embodiment

Next, wireless module 801 according to a fifth exemplary embodiment will be described.

Wireless module 801 according to the present exemplary embodiment has substantially the same configuration as wireless module 101 described in the second exemplary embodiment. However, wireless module 801 in the present exemplary embodiment is different from wireless module 101 in the second exemplary embodiment in that first antenna 830 and second antenna 840 have a shape adaptable for a dual band. Hereinafter, with regard to wireless module 801 according to the present exemplary embodiment, a description of the matters described in the first and second exemplary embodiments will be omitted as appropriate, and points of difference from wireless module 101 according to the second exemplary embodiment will be mainly described. Note that constituent elements substantially the same as the constituent elements included in wireless module 101 described in the second exemplary embodiment are denoted by the same reference numerals, and a description thereof is omitted or simplified.

[5-1. Configuration]

First, a configuration of wireless module 801 in the present exemplary embodiment will be described with reference to the drawings.

Figure 15A:
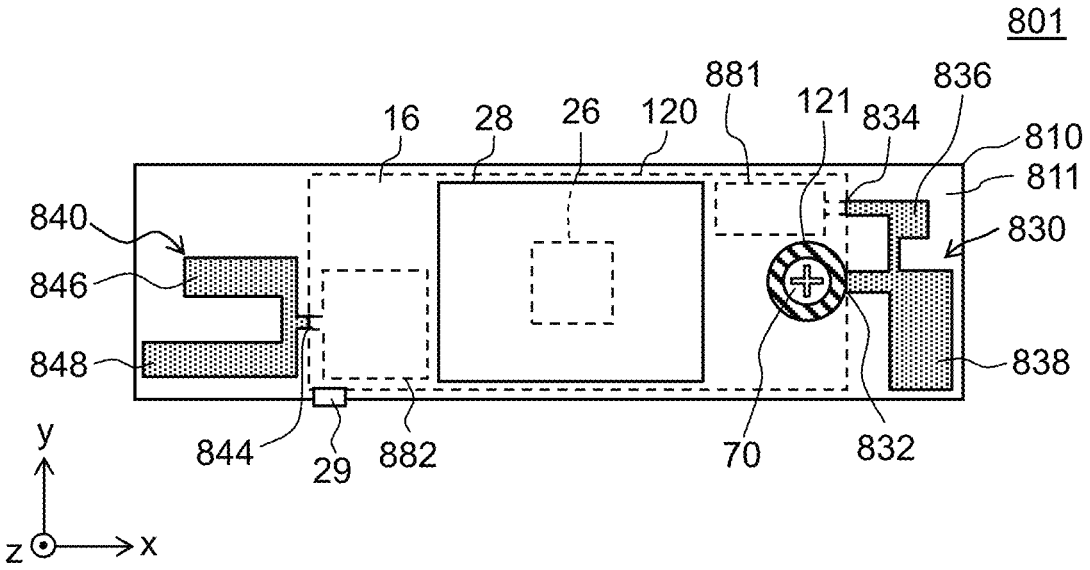
FIG. 15A is a top view schematically showing an example of an external appearance of a wireless module in a fifth exemplary embodiment.

FIG. 15A is a top view schematically showing an example of an external appearance of wireless module 801 in the fifth exemplary embodiment.

Figure 15B:
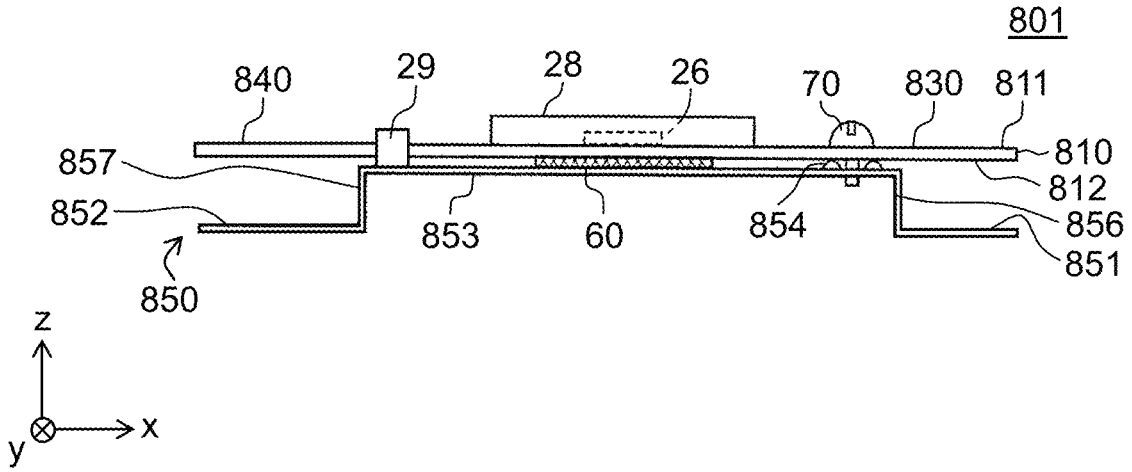
FIG. 15B is a side view schematically showing the example of the external appearance of the wireless module in the fifth exemplary embodiment.

FIG. 15B is a side view schematically showing the example of the external appearance of wireless module 801 in the fifth exemplary embodiment.

As shown in FIG. 15A, wireless module 801 includes substrate 810, ground patterns 120, IC 26, shield case 28, first antenna 830, second antenna 840, first matching circuit 881, second matching circuit 882, and spacer 29. Wireless module 801 further includes base plate 850, conductive screw 70, and heat conducting member 60, as shown in FIG. 15B.

As shown in FIG. 15B, substrate 810 has first main surface 811 on which first antenna 830 and second antenna 840 are formed, and second main surface 812 opposite to first main surface 811. Although not shown, substrate 810 is formed with a through hole at a position corresponding to the center of exposed portion 121 of ground pattern 120 as in substrate 110 of wireless module 101 described in the second exemplary embodiment.

First antenna 830 includes first grounding part 832 connected to ground pattern 120 and first power feeding part 834 fed with a first signal. The shape of first antenna 830 is different from the shape of first antenna 130 according to the second exemplary embodiment. First antenna 830 has a shape adaptable for the dual band. Specifically, first antenna 830 includes first band part 836 corresponding to a first frequency band, and second band part 838 corresponding to a second frequency band that is a frequency band lower than the first frequency band. With this configuration, first antenna 830 is adaptable for two frequency bands. The first frequency band is, for example, a 5 GHz band, and the second frequency band is, for example, a 2.4 GHz band. Note that, although the present exemplary embodiment illustrates such a configuration example in which first antenna 830 is adaptable for two frequency bands, the configuration of first antenna 830 is not limited thereto. First antenna 830 may have a configuration adaptable for three or more frequency bands.

First matching circuit 881 is a circuit similar to first matching circuit 181 according to the second exemplary embodiment. However, first matching circuit 881 is different from first matching circuit 181 in that first matching circuit 881 suppresses reflection, at first antenna 830, of signals of two frequency bands, which are the first frequency band and the second frequency band, output from IC 26.

The shape of second antenna 840 is different from the shape of second antenna 40 according to the second exemplary embodiment. Second antenna 840 has a shape adaptable for the dual band. Specifically, second antenna 840 includes first band part 846 corresponding to the first frequency band, and second band part 848 corresponding to the second frequency band that is a frequency band lower than the first frequency band. With this configuration, second antenna 840 is adaptable for two frequency bands.

Second matching circuit 882 is a circuit similar to second matching circuit 82 according to the second exemplary embodiment. However, second matching circuit 882 is different from second matching circuit 82 in that second matching circuit 882 suppresses reflection, at second antenna 840, of signals of two frequency bands, which are the first frequency band and the second frequency band, output from IC 26.

Base plate 850 includes first opposed portion 851, second opposed portion 852, third opposed portion 853, first gap formation portion 856, and second gap formation portion 857 (see FIG. 15B), as in base plate 150 described in the second exemplary embodiment. Base plate 850 further has, on third opposed portion 853, short-circuit points at which base plate 850 and ground patterns 120 are short-circuited to each other. The short-circuit points are disposed on third opposed portion 853 at positions nearer to first opposed portion 851 than to second opposed portion 852.

Moreover, base plate 850 includes one or a plurality of protrusions 854 as shown in FIG. 15B. Protrusions 854 are provided to be in contact with an exposed portion (not shown) provided in second main surface 812 of substrate 810 as in wireless module 101 described in the second exemplary embodiment. Further, base plate 850 is formed with a threaded hole (not shown) at a position corresponding to a through hole (not shown) formed in substrate 810 for passage of conductive screw 70. A threaded portion of conductive screw 70 that penetrates the through hole from first main surface 811 of substrate 810 is screwed into the threaded hole. In this way, base plate 850 is fixed to substrate 810 and is short-circuited to exposed portion 121 of ground pattern 120 via conductive screw 70. Further, the exposed portion provided in second main surface 812 of substrate 810 and protrusions 854 are short-circuited. Thus, in wireless module 801 according to the present exemplary embodiment, protrusions 854 and the threaded hole of base plate 850 constitute short-circuit points at which base plate 850 and ground patterns 120 are short-circuited to each other.

Moreover, base plate 850 of wireless module 801 has a configuration capable of enhancing isolation between first antenna 830 and second antenna 840 as in base plate 150 in the second exemplary embodiment. Base plate 850 has a configuration capable of enhancing isolation with respect to a resonance frequency in the frequency band in which an interference with second antenna 840 can be more increased, from among two frequency bands supported by first antenna 830. Specifically, base plate 850 is configured such that an electrical length from the short-circuit point, at which base plate 850 and ground patterns 120 are short-circuited to each other, to a vertex of base plate 850 closest to the short-circuit point is approximately ¼ times a resonance wavelength corresponding to the resonance frequency. In addition, base plate 850 is configured such that an electrical length in base plate 850 from an end of third opposed portion 853 closer to second opposed portion 852 to an opposite end of second opposed portion 852 from third opposed portion 853 is approximately ¼ times the resonance wavelength.

According to these configurations described above, in wireless module 801, the isolation between both antennas (first antenna 830 and second antenna 840) can be enhanced.

[5-2. Effects and Others]

As described above, the wireless module according to the present exemplary embodiment has a configuration substantially the same as the configuration of the wireless module in the second exemplary embodiment, and can provide substantially the same effect.

Note that wireless module 801 is an example of the wireless module. Substrate 810 is an example of the substrate. First antenna 830 is an example of the first antenna. Second antenna 840 is an example of the second antenna. Base plate 850 is an example of the base plate. First grounding part 832 is an example of the grounding part. First power feeding part 834 is an example of the first power feeding part. Second power feeding part 844 is an example of the second power feeding part. First opposed portion 851 is an example of the first opposed portion. Second opposed portion 852 is an example of the second opposed portion. Third opposed portion 853 is an example of the third opposed portion.

In the wireless module, the first antenna may have a shape adaptable for the dual band.

For example, in wireless module 801 in the example shown in the fifth exemplary embodiment, first antenna 830 has the shape adaptable for the dual band.

Thus, in wireless module 801, frequency bands that can be supported can be increased, and the isolation between first antenna 830 and second antenna 840 can be enhanced.

Now, the effect of wireless module 801 according to the present exemplary embodiment will be described. Here, a result of numerical analyses in a model corresponding to wireless module 801 will be described with reference to the drawings.

Figure 16:
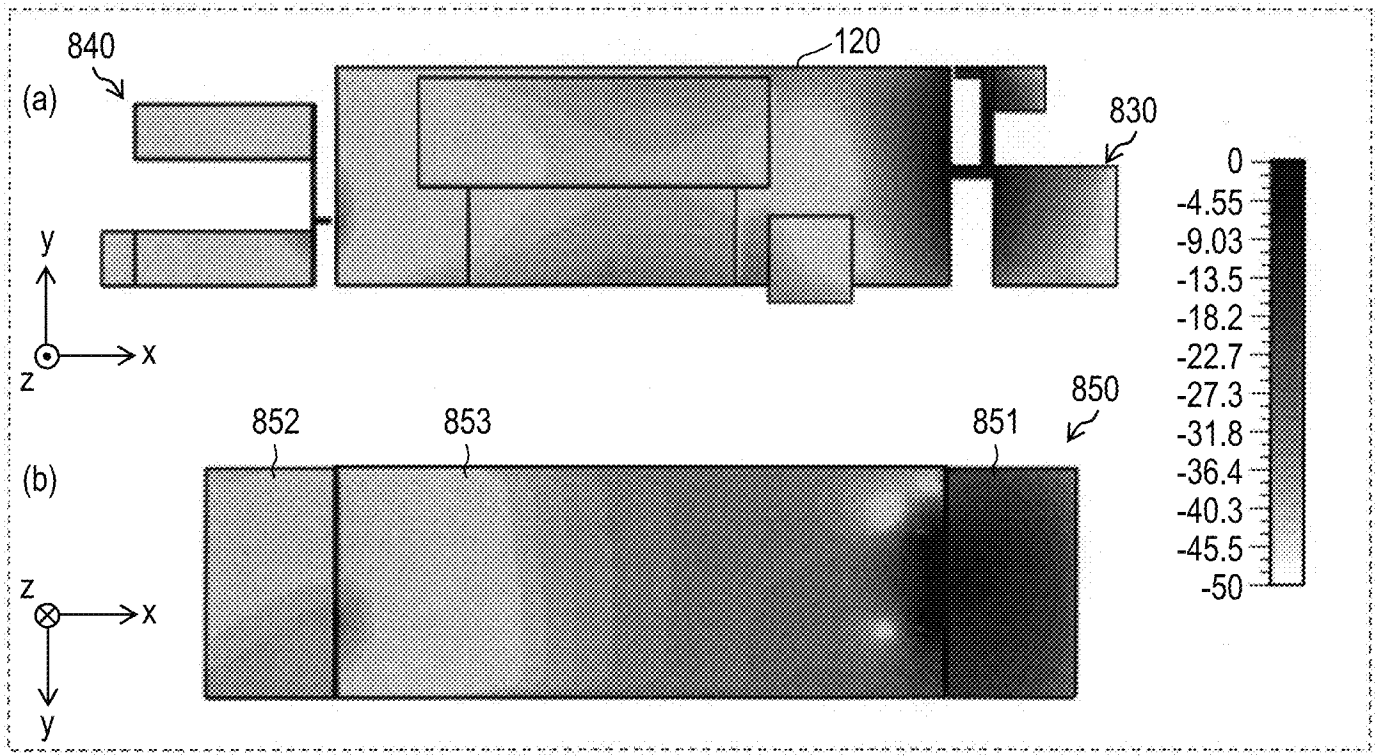
FIG. 16 is a current intensity distribution diagram showing one example of a result of numerical analyses in a model corresponding to the wireless module in the fifth exemplary embodiment.

FIG. 16 is a current intensity distribution diagram showing one example of a result of numerical analyses in the model corresponding to wireless module 801 in the fifth exemplary embodiment.

The current intensity distribution diagram shown in part (a) of FIG. 16 shows an intensity distribution of current flowing through first antenna 830, second antenna 840, and ground patterns 120, when the first signal is supplied to first antenna 830. The current intensity distribution diagram in part (b) of FIG. 16 shows an intensity distribution of current flowing through base plate 850, when the first signal is supplied to first antenna 830.

As shown in part (a) and part (b) of FIG. 16, the current intensity near first antenna 830 and first opposed portion 851 of base plate 850 is relatively high, whereas the current intensity near second antenna 840 is low enough to ensure the isolation. Therefore, in wireless module 801 according to the present exemplary embodiment, the isolation between first antenna 830 and second antenna 840 can be enhanced.

First Modification of Fifth Exemplary Embodiment

Next, wireless module 901 according to a first modification of the fifth exemplary embodiment will be described.

Wireless module 901 according to the present modification has substantially the same configuration as wireless module 801 described in the fifth exemplary embodiment. However, wireless module 901 described in the present modification is different from wireless module 801 according to the fifth exemplary embodiment in that the second antenna is a PIFA. Hereinafter, with regard to wireless module 901 according to the present modification, a description of the matters described in the first to fifth exemplary embodiments will be omitted as appropriate, and points of difference from wireless module 801 according to the fifth exemplary embodiment will be mainly described. Note that constituent elements substantially the same as the constituent elements included in wireless module 801 described in the fifth exemplary embodiment are denoted by the same reference numerals, and a description thereof is omitted or simplified.

[5A-1. Configuration]

First, a configuration of wireless module 901 in the present modification will be described with reference to the drawings.

Figure 17A:
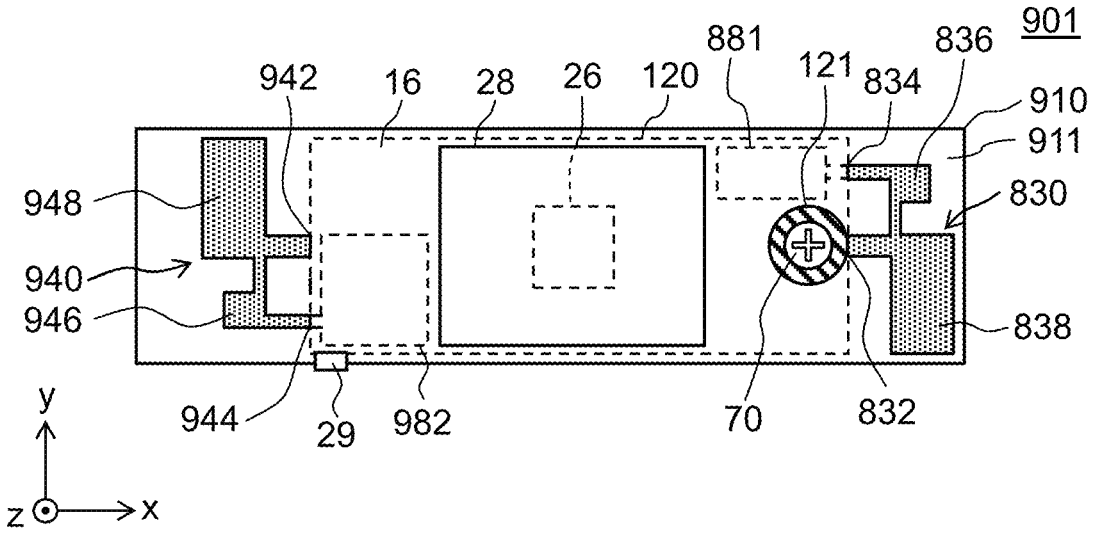
FIG. 17A is a top view schematically showing an example of an external appearance of a wireless module in a first modification of the fifth exemplary embodiment.

FIG. 17A is a top view schematically showing an example of an external appearance of wireless module 901 in the first modification of the fifth exemplary embodiment.

Figure 17B:
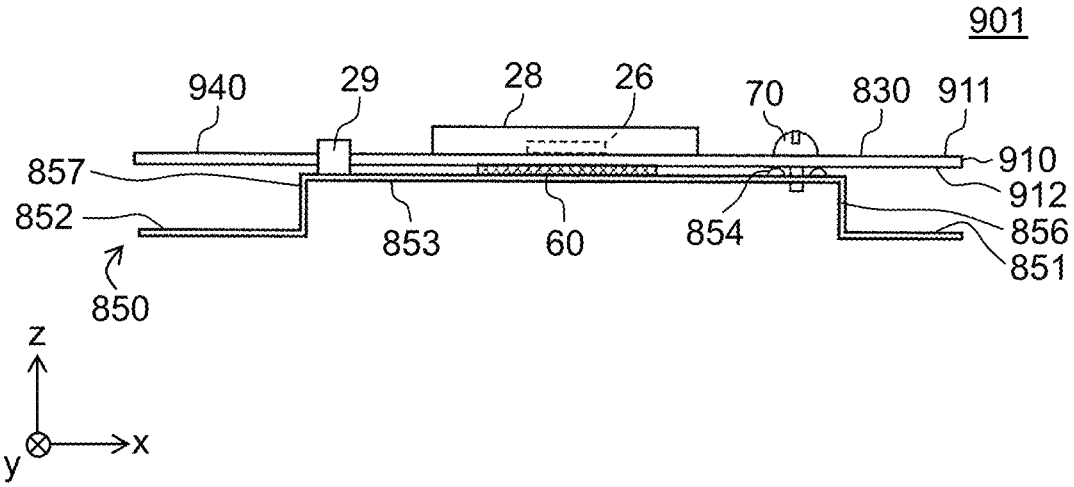
FIG. 17B is a side view schematically showing the example of the external appearance of the wireless module in the first modification of the fifth exemplary embodiment.

FIG. 17B is a side view schematically showing the example of the external appearance of wireless module 901 in the first modification of the fifth exemplary embodiment.

As shown in FIG. 17A, wireless module 901 includes substrate 910, ground patterns 120, IC 26, shield case 28, first antenna 830, second antenna 940, first matching circuit 881, second matching circuit 982, and spacer 29. Wireless module 901 further includes base plate 850, conductive screw 70, and heat conducting member 60, as shown in FIG. 17B. Wireless module 901 according to the present modification is different mainly in the configuration of second antenna 940 from wireless module 801 according to the fifth exemplary embodiment.

As shown in FIG. 17B, substrate 910 has first main surface 911 on which first antenna 830 and second antenna 940 are formed, and second main surface 912 opposite to first main surface 911. Although not shown, substrate 910 is formed with a through hole at a position corresponding to the center of exposed portion 121 of ground pattern 120 as in substrate 810 of wireless module 801 described in the fifth exemplary embodiment.

As shown in FIG. 17A, second antenna 940 is the PIFA which includes second grounding part 942 connected to ground pattern 120 and second power feeding part 944 fed with a second signal. Like first antenna 830, second antenna 940 is an antenna adaptable for the dual band. Second antenna 940 includes first band part 946 corresponding to a first frequency band, and second band part 948 corresponding to a second frequency band that is a frequency band lower than the first frequency band.

Like second matching circuit 882, second matching circuit 982 is a circuit that suppresses reflection, at second antenna 940, of signals of two frequency bands included in the second signal.

[5A-2. Effects and Others]

As described above, the wireless module according to the present modification has a configuration substantially the same as the configuration of the wireless module in the fifth exemplary embodiment, and can provide substantially the same effect.

Note that wireless module 901 is an example of the wireless module. Substrate 910 is an example of the substrate. Second antenna 940 is an example of the second antenna. Second power feeding part 944 is an example of the second power feeding part.

In wireless module 901 in the example shown in the first modification of the fifth exemplary embodiment, second antenna 940 is the PIFA.

In wireless module 901 according to the present modification, the intensity of current flowing near second antenna 940 is also sufficiently suppressed as shown in FIG. 16, whereby the isolation between first antenna 830 and second antenna 940 can be enhanced.

Sixth Exemplary Embodiment

Next, wireless module 1001 according to a sixth exemplary embodiment will be described.

Wireless module 1001 according to the present exemplary embodiment has substantially the same configuration as wireless module 901 described in the first modification of the fifth exemplary embodiment. However, wireless module 1001 in the present exemplary embodiment is different from wireless module 901 in the first modification of the fifth exemplary embodiment in that base plate 1050 has an isolation effect corresponding to the dual band. Hereinafter, with regard to wireless module 1001 according to the present exemplary embodiment, a description of the matters described in the first to fifth exemplary embodiments and the first modification of the fifth exemplary embodiment will be omitted as appropriate, and points of difference from wireless module 901 according to the first modification of the fifth exemplary embodiment will be mainly described. Note that constituent elements substantially the same as the constituent elements included in wireless module 901 described in the first modification of the fifth exemplary embodiment are denoted by the same reference numerals, and a description thereof is omitted or simplified.

[6-1. Configuration]

First, a configuration of wireless module 1001 in the present exemplary embodiment will be described with reference to the drawings.

Figure 18A:
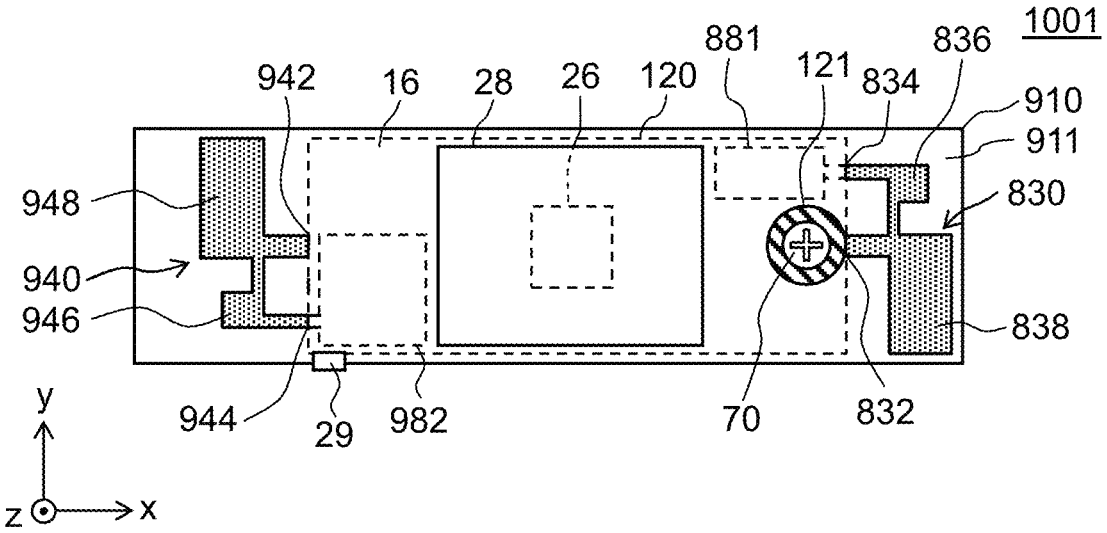
FIG. 18A is a top view schematically showing an example of an external appearance of a wireless module in a sixth exemplary embodiment.

FIG. 18A is a top view schematically showing an example of an external appearance of wireless module 1001 in the sixth exemplary embodiment.

Figure 18B:
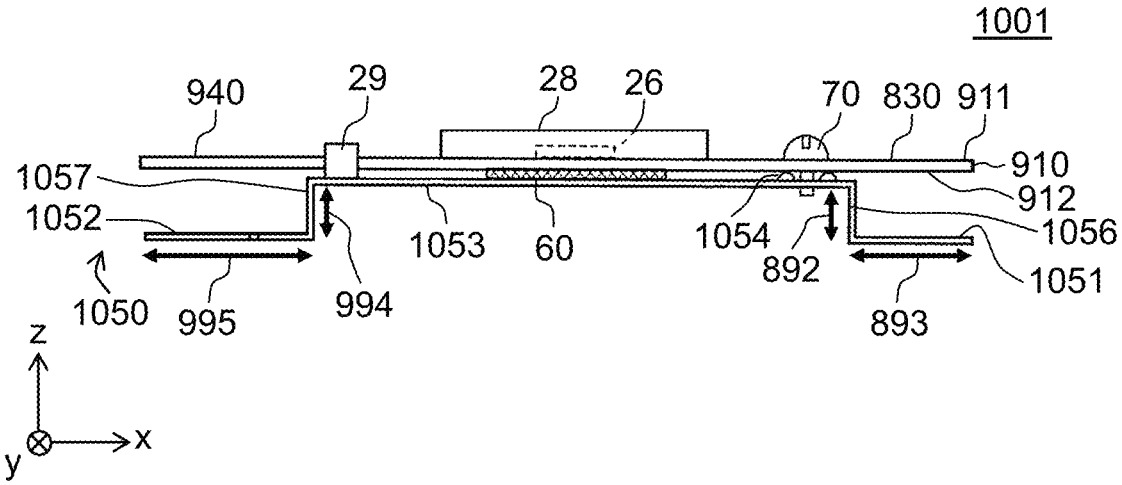
FIG. 18B is a side view schematically showing the example of the external appearance of the wireless module in the sixth exemplary embodiment.

FIG. 18B is a side view schematically showing the example of the external appearance of wireless module 1001 in the sixth exemplary embodiment.

Figure 19:
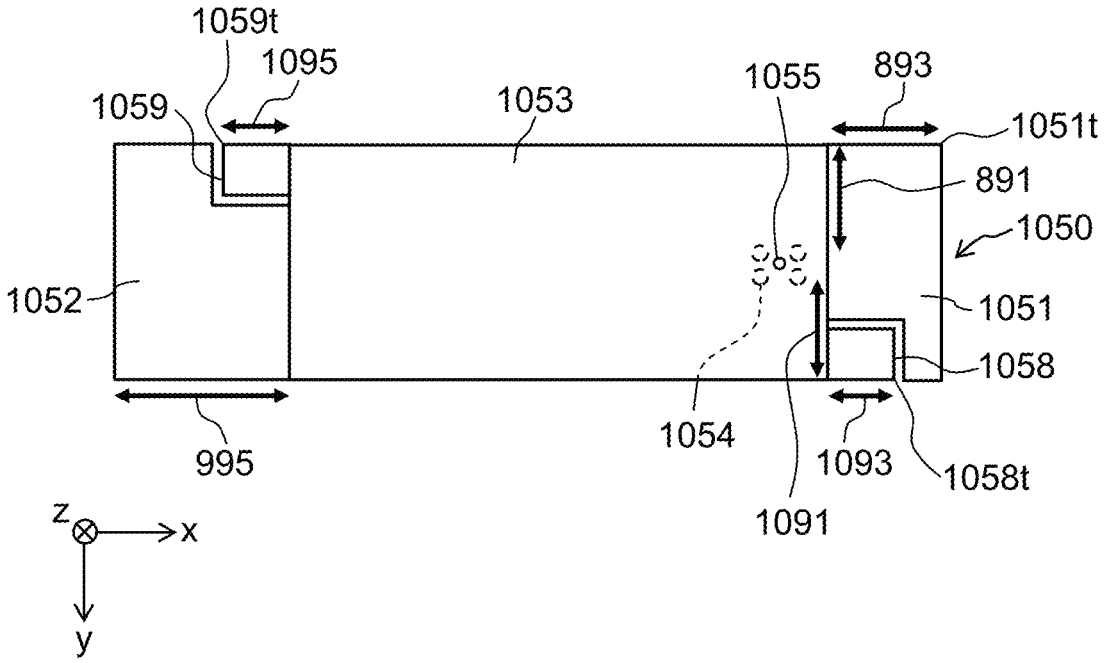
FIG. 19 is a bottom view schematically showing an example of an external appearance of a base plate of the wireless module in the sixth exemplary embodiment.

FIG. 19 is a bottom view schematically showing an example of an external appearance of base plate 1050 of wireless module 1001 in the sixth exemplary embodiment.

As shown in FIG. 18A, wireless module 1001 includes substrate 910, ground patterns 120, IC 26, shield case 28, first antenna 830, second antenna 940, first matching circuit 881, second matching circuit 982, and spacer 29. Wireless module 1001 further includes base plate 1050, conductive screw 70, and heat conducting member 60, as shown in FIG. 18B. The configuration of base plate 1050 in wireless module 1001 according to the present exemplary embodiment is different from the configuration of base plate 850 in wireless module 901 according to the first modification of the fifth exemplary embodiment.

Base plate 1050 includes first opposed portion 1051, second opposed portion 1052, third opposed portion 1053, first gap formation portion 1056, and second gap formation portion 1057 (see FIG. 18B), as in base plate 850 described in the first modification of the fifth exemplary embodiment. Base plate 1050 also has, on third opposed portion 1053, short-circuit points at which base plate 1050 and ground patterns 120 are short-circuited to each other. The short-circuit points are disposed on third opposed portion 1053 at positions nearer to first opposed portion 1051 than to second opposed portion 1052.

Further, base plate 1050 includes one or a plurality (for example, four) of protrusions 1054 as shown in FIGS. 18B and 19. Protrusions 1054 are provided to be in contact with an exposed portion (not shown) provided in second main surface 912 of substrate 910 as in wireless module 101 described in the second exemplary embodiment. Further, as shown in FIG. 19, base plate 1050 is formed with threaded hole 1055 at a position corresponding to a through hole (not shown) formed in substrate 910 for passage of conductive screw 70. A threaded portion of conductive screw 70 that penetrates the through hole from first main surface 911 of substrate 910 is screwed into threaded hole 1055. In this way, base plate 1050 is fixed to substrate 910 and is short-circuited to exposed portion 121 of ground pattern 120 via conductive screw 70. Further, the exposed portion provided in second main surface 912 of substrate 910 and protrusions 1054 are short-circuited. Thus, in wireless module 1001 according to the present exemplary embodiment, protrusions 1054 and threaded hole 1055 of base plate 1050 constitute short-circuit points at which base plate 1050 and ground patterns 120 are short-circuited to each other.

Further, base plate 1050 in wireless module 1001 according to the present exemplary embodiment has a configuration for providing an isolation effect corresponding to the dual band. Specifically, first cut 1058 having substantially an L-shape is formed in first opposed portion 1051 of base plate 1050 as shown in FIG. 19. In addition, second cut 1059 having substantially an L-shape is also formed in second opposed portion 1052 of base plate 1050.

In base plate 1050, first cut 1058 forms a vertex of base plate 1050. Specifically, vertex 1058*t* formed by first cut 1058 as well as vertex 1051*t* shown in FIG. 19 function as the vertex closest to the short-circuit point of base plate 1050.

Therefore, in wireless module 1001 according to the present exemplary embodiment, base plate 1050 is configured such that an electrical length from the short-circuit point to vertex 1051*t* becomes approximately ¼ times the longer resonance wavelength of two resonance wavelengths of first antenna 830. In addition, base plate 1050 is configured such that an electrical length from the short-circuit point to vertex 1058*t* becomes approximately ¼ times the shorter resonance wavelength of two resonance wavelengths of first antenna 830. Due to base plate 1050 having the configuration described above, wireless module 1001 according to the present exemplary embodiment has the isolation effect corresponding to the dual band.

Specifically, in wireless module 1001, base plate 1050 is configured such that the sum of a distance (distance indicated by arrow 891 in FIG. 19) from the short-circuit point to a point corresponding to a foot of a perpendicular line from the short-circuit point to an edge of base plate 1050 closest to the short-circuit point and a length (sum of a length indicated by arrow 892 and a length indicated by arrow 893 in FIG. 18B) of an edge of base plate 1050 from the point to vertex 1051*t* becomes approximately ¼ times the longer resonance wavelength of two resonance wavelengths of first antenna 830. In addition, base plate 1050 is configured such that the sum of a distance (distance indicated by arrow 1091 in FIG. 19) from the short-circuit point to a point corresponding to a foot of a perpendicular line from the short-circuit point to an edge of base plate 1050 closest to the short-circuit point and a length (sum of a length indicated by arrow 892 in FIG. 18B and a length indicated by arrow 1093 in FIG. 19) of an edge of base plate 1050 from the point to vertex 1058*t* becomes approximately ¼ times the shorter resonance wavelength of two resonance wavelengths of first antenna 830.

In base plate 1050, second cut 1059 also forms a vertex of base plate 1050. That is, vertex 1059*t* formed by second cut 1059 shown in FIG. 19 also functions as the vertex of base plate 1050.

Therefore, in wireless module 1001 according to the present exemplary embodiment, base plate 1050 is configured such that an electrical length in base plate 1050 from an end of third opposed portion 1053 closer to second opposed portion 1052 to an opposite end of second opposed portion 1052 from third opposed portion 1053 becomes approximately ¼ times the longer resonance wavelength of two resonance wavelengths of first antenna 830. In addition, base plate 1050 is configured such that an electrical length in base plate 1050 from an end of third opposed portion 1053 closer to second opposed portion 1052 to vertex 1059*t* of second opposed portion 1052 becomes approximately ¼ times the shorter resonance wavelength of two resonance wavelengths of first antenna 830. Due to base plate 1050 having the configuration described above, wireless module 1001 according to the present exemplary embodiment has the isolation effect corresponding to the dual band.

Specifically, in wireless module 1001, base plate 1050 is configured such that the sum of the length of an edge of second gap formation portion 1057 indicated by arrow 994 in FIG. 18B and the length, indicated by arrow 995 in FIG. 19, from the edge of second opposed portion 1052 closer to third opposed portion 1053 to an opposite edge of second opposed portion 1052 from third opposed portion 1053 becomes approximately ¼ times the longer resonance wavelength of two resonance wavelengths of first antenna 830. In addition, base plate 1050 is configured such that the sum of the length of the edge of second gap formation portion 1057 indicated by arrow 994 in FIG. 18B and the length, indicated by arrow 1095 in FIG. 19, from vertex 1059*t* to an edge of second opposed portion 1052 closer to third opposed portion 1053 becomes approximately ¼ times the shorter resonance wavelength of two resonance wavelengths of first antenna 830.

[6-2. Effects and Others]

As described above, the wireless module according to the present exemplary embodiment has a configuration substantially the same as the configuration of the wireless module in the first modification of the fifth exemplary embodiment, and can provide substantially the same effect.

Note that wireless module 1001 is an example of the wireless module. Base plate 1050 is an example of the base plate. First opposed portion 1051 is an example of the first opposed portion. Second opposed portion 1052 is an example of the second opposed portion. Third opposed portion 1053 is an example of the third opposed portion.

In the wireless module, the first antenna may have a shape adaptable for the dual band, and a first cut may be formed in the first opposed portion. An electrical length from the short-circuit point to the first cut (vertex formed by the first cut) may be approximately ¼ times a shorter resonance wavelength of two resonance wavelengths of the first antenna.

Note that first cut 1058 is an example of the first cut. Vertex 1058*t* is an example of the vertex formed by the first cut.

For example, in wireless module 1001 in the example described in the sixth exemplary embodiment, first cut 1058 is formed in first opposed portion 1051, and the electrical length from the short-circuit point to first cut 1058 (vertex 1058*t* formed by first cut 1058) is approximately ¼ times the shorter resonance wavelength of two resonance wavelengths of first antenna 830.

Thus, wireless module 1001 has the isolation effect corresponding to the dual band between first antenna 830 and second antenna 940.

Further, in the wireless module, a second cut may be formed in the second opposed portion. An electrical length from an end of the third opposed portion closer to the second opposed portion to the second cut (vertex formed by the second cut) may be approximately ¼ times a shorter resonance wavelength of two resonance wavelengths of the first antenna.

Note that second cut 1059 is an example of the second cut. Vertex 1059*t* is an example of the vertex formed by the second cut.

For example, in wireless module 1001 in the example described in the sixth exemplary embodiment, second cut 1059 is formed in second opposed portion 1052, and the electrical length from the end of third opposed portion 1053 closer to second opposed portion 1052 to second cut 1059 (vertex 1059*t* formed by second cut 1059) is approximately ¼ times the shorter resonance wavelength of two resonance wavelengths of first antenna 830.

Thus, wireless module 1001 has the isolation effect corresponding to the dual band between first antenna 830 and second antenna 940.

Seventh Exemplary Embodiment

Next, wireless module 1101 according to a seventh exemplary embodiment and image display device 1190 including wireless module 1101 will be described. Wireless module 1101 according to the present exemplary embodiment has substantially the same configuration as wireless module 1 described in the first exemplary embodiment. However, wireless module 1101 described in the seventh exemplary embodiment is different from wireless module 1 according to the first exemplary embodiment in the shape of the base plate. The other configurations of wireless module 1101 are substantially the same as those of wireless module 1. Hereinafter, wireless module 1101 according to the present exemplary embodiment and image display device 1190 including wireless module 1101 will be described with reference to the drawings. Note that constituent elements substantially the same as the constituent elements included in wireless module 1 described in the first exemplary embodiment are denoted by the same reference numerals, and a description thereof is omitted or simplified. Moreover, a description of the matters described in the first to sixth exemplary embodiments will be omitted as appropriate.

[7-1. Configuration]

Figure 20:
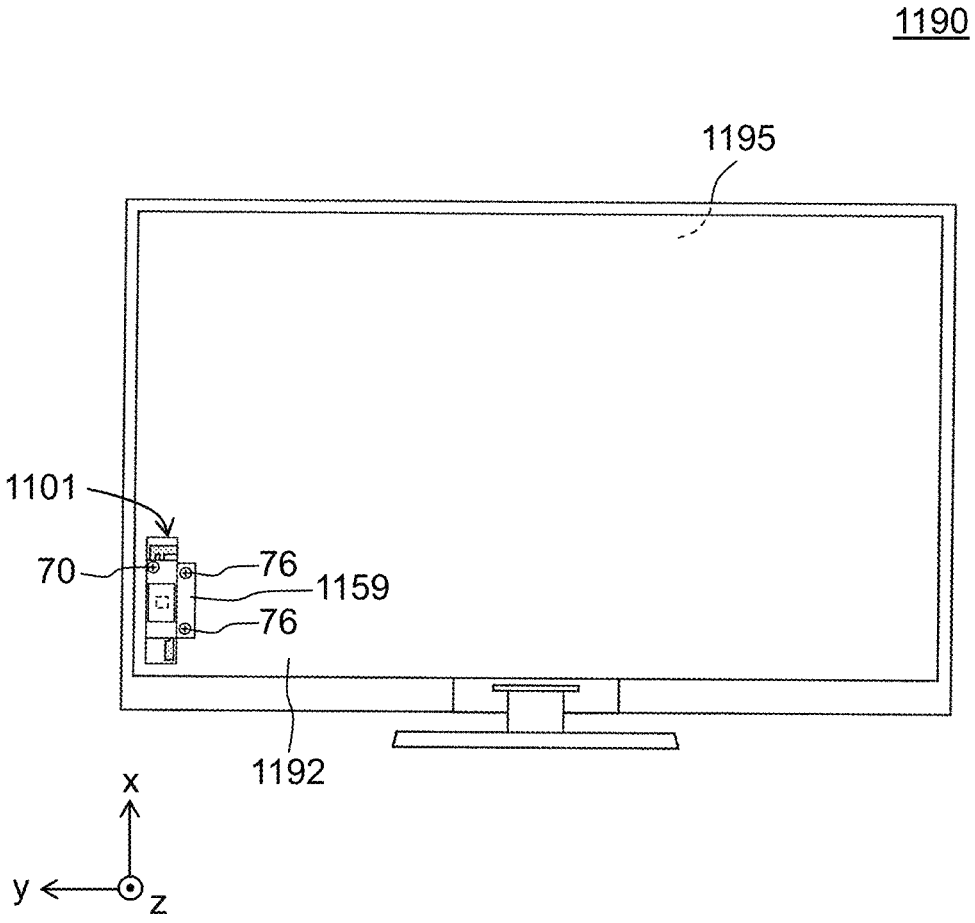
FIG. 20 is a rear view schematically showing an example of an external appearance of an image display device including a wireless module in a seventh exemplary embodiment.

FIG. 20 is a rear view schematically showing an example of an external appearance of image display device 1190 including wireless module 1101 in the seventh exemplary embodiment.

Figure 21:
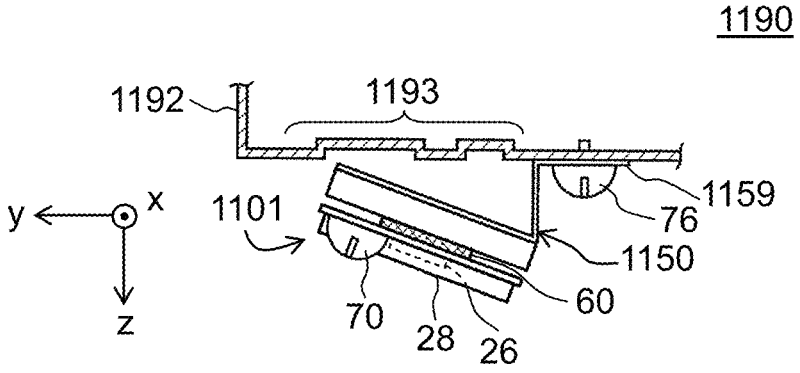
FIG. 21 is an enlarged top view showing a portion to which the wireless module is attached in the image display device in the seventh exemplary embodiment.

FIG. 21 is an enlarged top view showing a portion to which wireless module 1101 is attached in image display device 1190 in the seventh exemplary embodiment.

Figure 22:
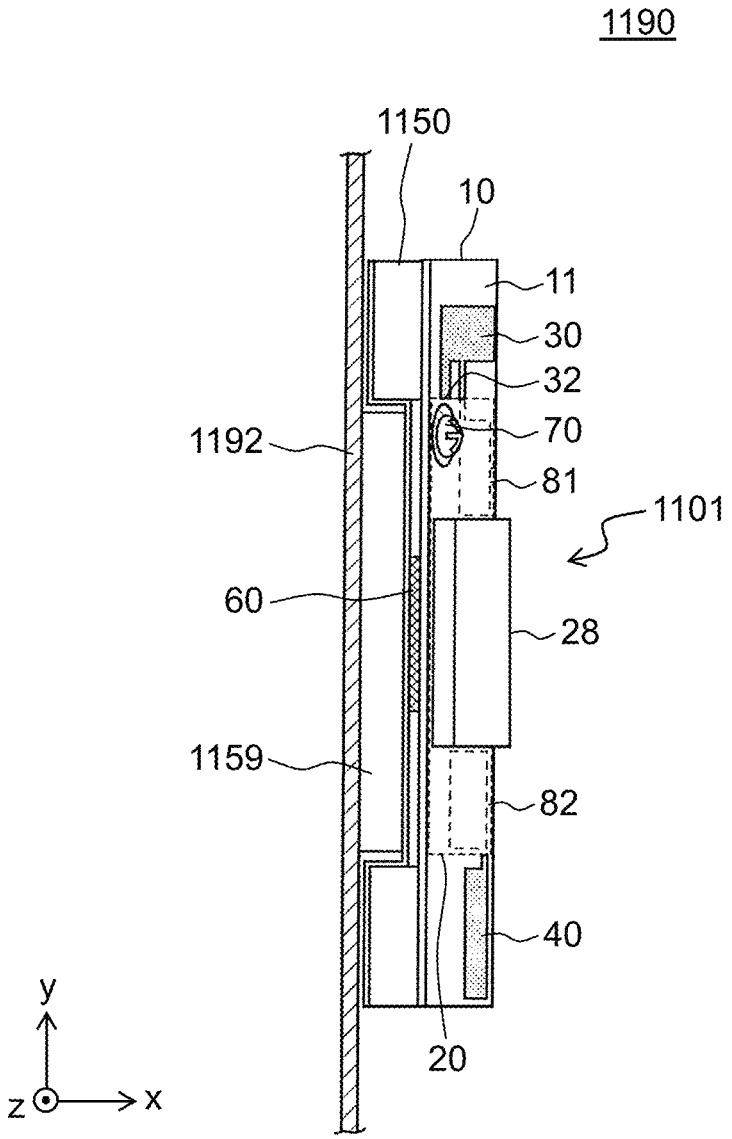
FIG. 22 is an enlarged side view showing the portion to which the wireless module is attached in the image display device in the seventh exemplary embodiment.

FIG. 22 is an enlarged side view showing the portion to which wireless module 1101 is attached in image display device 1190 in the seventh exemplary embodiment.

Note that FIGS. 21 and 22 show a cross-sectional view of chassis 1192 in order to describe a cross-sectional shape of chassis 1192 to which wireless module 1101 is attached.

Note that, in FIGS. 20 to 22, a direction that is a vertical direction and also a longitudinal direction of wireless module 1101 is defined as the x-axis direction, and an upward orientation in the vertical direction is defined as a positive direction of the x axis. Moreover, a direction perpendicular to the x-axis direction and perpendicular to a front surface of image display device 1190 (that is, a surface on which a display screen is disposed) and to a rear surface of image display device 1190 (that is, a back surface of the display screen) is defined as the z-axis direction, and a direction perpendicular to the x-axis direction and the z-axis direction is defined as the y-axis direction.

Image display device 1190 shown in FIGS. 20 to 21 is, for example, a television receiver. Image display device 1190 includes wireless module 1101, chassis 1192 to which wireless module 1101 is attached, and display unit 1195 that displays an image. Display unit 1195 is disposed on the front surface of image display device 1190.

As shown in FIG. 20, wireless module 1101 is disposed near an end in the y-axis direction of metal chassis 1192 disposed on a rear surface side of image display device 1190. Thus, wireless module 1101 can be disposed at a position that cannot be viewed from a front surface side of image display device 1190. Moreover, in the present exemplary embodiment, wireless module 1101 is disposed near the end of chassis 1192, whereby a component diffracted from a rear surface side of image display device 1190 to a front surface side of image display device 1190 at the end of chassis 1192 in the electromagnetic wave radiated from wireless module 1101 can be increased. Note that, for example, wireless module 1101 may be disposed near an end in the x-axis direction of chassis 1192 of image display device 1190.

As shown in FIGS. 20 and 21, base plate 1150 of wireless module 1101 has a configuration in which attachment part 1159 for attaching wireless module 1101 to chassis 1192 is provided to base plate 50 shown in the first exemplary embodiment. Two through holes (not shown) are formed in attachment part 1159, and screws 76 are individually inserted into the two through holes. Two screws 76 are each screwed into two threaded holes (not shown), which are formed in chassis 1192, through attachment part 1159, whereby base plate 1150 is fixed to chassis 1192. In this way, wireless module 1101 is fixed to chassis 1192.

In image display device 1190, first antenna 30 and second antenna 40 of wireless module 1101 are disposed so as to be inclined with respect to chassis 1192, as shown in FIGS. 21 and 22. That is, in wireless module 1101, when attachment part 1159 is attached to chassis 1192, base plate 1150 is formed such that first antenna 30 and second antenna 40 (that is, substrate 10) can be inclined with respect to a surface of chassis 1192, to which attachment part 1159 is attached. In other words, in base plate 1150, attachment part 1159 is inclined with respect to third opposed portion 53 (refer to FIGS. 1A and 1C).

Thus, in image display device 1190, the component propagating from the rear surface side of image display device 1190 to the front surface side of image display device 1190 in the electromagnetic wave radiated from wireless module 1101 can be increased.

Note that, in image display device 1190, a shape of a portion of chassis 1192, to which wireless module 1101 is attached, is not necessarily flat, and may have various shapes according to a structure of image display device 1190. Specifically, as illustrated in FIG. 21, chassis 1192 may have irregularities 1193 with various shapes in a portion near wireless module 1101. However, in the present exemplary embodiment, base plate 1150 of wireless module 1101 is disposed between chassis 1192 and substrate 10 provided with first antenna 30 and second antenna 40. Therefore, metal closest to chassis 1192 is base plate 1150. From this, even when chassis 1192 has irregularities 1193, an impact of the shapes of irregularities 1193 on the radiation characteristics of the electromagnetic wave is suppressed in wireless module 1101, and radiation characteristics, which are always stable, can be obtained in first antenna 30 and second antenna 40.

Note that, in image display device 1190 shown in FIG. 20, chassis 1192 is exposed on the rear surface. However, image display device 1190 may include a rear surface cover that covers chassis 1192 and wireless module 1101. In that case, the rear surface cover has a configuration of transmitting the electromagnetic wave. For example, the rear surface cover is formed of an insulating material.

Note that, in the present exemplary embodiment, the television receiver is illustrated as an example of image display device 1190 as an object to which wireless module 1101 is to be fixed; however, image display device 1190 is not limited to the television receiver. For example, image display device 1190 may be a display device for a personal computer, or the like.

Note that, in the present exemplary embodiment, wireless module 1101 has substantially the same configuration as that of wireless module 1 described in the first exemplary embodiment except that base plate 1150 has attachment part 1159. However, wireless module 1101 described in the seventh exemplary embodiment may be configured to include attachment part 1159 in any one of the wireless modules described in the second to sixth exemplary embodiments.

[7-2. Effects and Others]

As described above, in the present exemplary embodiment, an image display device includes: a wireless module; a chassis to which the wireless module is attached; and a display unit that displays an image. In the image display device, a base plate of the wireless module is disposed between the substrate and the chassis.

Note that image display device 1190 is an example of the image display device. Wireless module 1101 is an example of the wireless module. Chassis 1192 is an example of the chassis. Display unit 1195 is an example of the display unit. Base plate 1150 is an example of the base plate. Substrate 10 is an example of the substrate.

For example, in the example shown in the seventh exemplary embodiment, image display device 1190 includes: wireless module 1101; chassis 1192 to which wireless module 1101 is attached; and display unit 1195 that displays an image. In image display device 1190, base plate 1150 is disposed between substrate 10 and chassis 1192.

In image display device 1190 thus configured, a portion of current flowing from first grounding part 32 of first antenna 30 toward ground patterns 20 flows into base plate 1150. Due to the reduction in the current flowing from first antenna 30 toward ground patterns 20 as described above, current flowing through ground patterns 20 to the vicinity of second antenna 40 is reduced in wireless module 1101. Therefore, in wireless module 1101, isolation between first antenna 30 and second antenna 40 can be enhanced.

Other Exemplary Embodiments

The first to seventh exemplary embodiments and the modifications have been described above as illustrations of the technique disclosed in the present application. However, the technique in the present disclosure is not limited thereto, and can also be applied to exemplary embodiments subjected to alteration, substitution, addition, omission and the like. In addition, a new exemplary embodiment can be made by combining constituents described in the above first to seventh exemplary embodiments or the modifications.

Hence, other exemplary embodiments will be described below.

The above exemplary embodiments and the modifications have described such a configuration example in which, in the wireless module, the first antenna and the second antenna are formed on the first main surface of the substrate. However, the present disclosure is not limited to this configuration example. For example, in the wireless module, the first antenna and the second antenna may be formed on the second main surface of the substrate.

The above exemplary embodiments and modifications have described such a configuration example in which, in the wireless module, the first antenna and the second antenna are exposed without being covered with the resist. However, the present disclosure is not limited to this configuration example. For example, in the wireless module, the first antenna and the second antenna may be covered with the resist. In this configuration, the first antenna and the second antenna can be protected by the resist.

The above exemplary embodiments and modifications have described such a configuration example in which, in the wireless module, the base plate is fixed to the substrate by using the conductive screw, whereby the conduction between the base plate and the ground pattern on the first main surface of the substrate is further stabilized. However, the present disclosure is not limited to this configuration example. For example, a non-conductive screw may be used in the wireless module. In the wireless module described in the present disclosure, even if the non-conductive screw is used, the ground pattern on the first main surface of the substrate can be electrically connected to the base plate via the through holes, the via electrodes, and the like and the ground pattern on the second main surface.

The above exemplary embodiments and modifications have described such a configuration example in which, in the wireless module, the heat conducting member is provided between the heat generating component and the base plate. However, the present disclosure is not limited to this configuration example. In the wireless module, the heat conducting member is not absolutely necessary. For example, the base plate and the resist of the substrate may be in direct contact with each other.

The exemplary embodiments and the modifications have been described above as the illustrations of the technique disclosed in the present disclosure. For this purpose, the accompanying drawings and the detailed description have been provided.

Accordingly, the components described in the attached drawings and the detailed description include not only the components essential for solving the problem but also components that are not essential for solving the problem in order to illustrate the technique. Therefore, those non-essential components should not readily be recognized as being essential for the reason that they appear in the accompanying drawings and/or in the detailed description.

The above exemplary embodiments are provided to exemplify the technique according to the present disclosure, and thus various changes, replacements, additions, omissions, and the like can be made within the scope of the claims and equivalents thereof. In addition, a new exemplary embodiment can be made by combining constituents described in the above first to seventh exemplary embodiments and modifications.

INDUSTRIAL APPLICABILITY

The present disclosure is applicable to a wireless communication device and an electrical device having a wireless communication function. Specifically, the present disclosure is applicable to a wireless LAN terminal, a wireless LAN router, a television receiver, a display device for a personal computer, and the like.

REFERENCE MARKS IN THE DRAWINGS

1, 101, 201, 301, 401, 501, 601, 701, 801, 901, 1001, 1101: wireless module
10, 110, 210, 310, 810, 910: substrate
11, 111, 211, 311, 811, 911: first main surface
12, 112, 212, 312, 812, 912: second main surface
13, 113, 213, 213*a*, 213*b*, 313: through hole
16: resist
20, 120, 220, 320: ground pattern
21, 22, 121, 122, 221, 221*a*, 221*b*, 222, 222*a*, 222*b*, 321, 322: exposed portion
26: IC
28: shield case
29: spacer
30, 130, 830: first antenna
32, 132, 832: first grounding part
34, 134, 834: first power feeding part
40, 840, 940: second antenna
44, 844, 944: second power feeding part

50, 150, 250, 350, 450, 550, 650, 750, 850, 1050, 1150: base plate
51, 151, 251, 351, 451, 551, 651, 751, 851, 1051: first opposed portion
51*t*, 151*t*, 1051*t*, 1058*t*, 1059*t*: vertex
52, 152, 252, 352, 452, 552, 652, 752, 852, 1052: second opposed portion
53, 153, 253, 353, 453, 553, 653, 753, 853, 1053: third opposed portion
54, 154, 254, 254*a*, 254*b*, 354, 454, 554, 654, 754, 854, 1054: protrusion
55, 155, 255, 255*a*, 255*b*, 355, 455, 555, 755, 1055: threaded hole
56, 156, 256, 356, 456, 556, 656, 756, 856, 1056: first gap formation portion
57, 157, 257, 357, 457, 557, 657, 757, 857, 1057: second gap formation portion
60: heat conducting member
62, 64: dielectric
70, 70*a*, 70*b*: conductive screw
76: screw
81, 181, 281, 381, 881: first matching circuit
82, 882, 982: second matching circuit
91, 92, 93, 94, 95, 191, 192, 193, 291, 292, 293, 391, 392, 393, 495, 496, 891, 892, 893, 994, 995, 1091, 1093, 1095: arrow
458: cut
758, 759: reactance element
836, 846, 946: first band part
838, 848, 948: second band part
942: second grounding part
1058: first cut
1059: second cut
1159: attachment part
1190: image display device
1192: chassis
1193: irregularities
1195: display unit

The invention claimed is:

1. A wireless module comprising:
a substrate;
a ground pattern disposed on the substrate;
a first antenna disposed between one end of the substrate and the ground pattern, the first antenna including a grounding part and a first power feeding part, the grounding part being connected to the ground pattern, the first power feeding part being fed with a first signal;
a second antenna disposed between another end of the substrate and the ground pattern, the second antenna including a second power feeding part fed with a second signal; and
a base plate that is conductive, the base plate including a first opposed portion that faces the first antenna, a second opposed portion that faces the second antenna, and a third opposed portion that faces the ground pattern and is short-circuited to the ground pattern,
wherein the base plate has, on the third opposed portion, a short-circuit point at which the base plate and the ground pattern are short-circuited to each other,
the short-circuit point is disposed at a position nearer to the first opposed portion than to the second opposed portion.

2. The wireless module according to claim 1, wherein the short-circuit point is disposed near the grounding part.

3. The wireless module according to claim 1, wherein an electrical length from the short-circuit point to a vertex of the base plate closest to the short-circuit point is approximately ¼ times a resonance wavelength of the first antenna.

4. The wireless module according to claim 1, wherein an electrical length from an end of the third opposed portion closer to the second opposed portion to an opposite end of the second opposed portion from the third opposed portion is approximately ¼ times a resonance wavelength of the first antenna.

5. The wireless module according to claim 1, wherein the short-circuit point is disposed in substantially a center in an edge direction of the third opposed portion, the edge direction being along an edge closer to the first opposed portion.

6. The wireless module according to claim 1, further comprising a conductive fastening member that is disposed on the short-circuit point and fastens the substrate and the base plate to each other.

7. The wireless module according to claim 1, wherein a cut is formed at an end of the second opposed portion closer to the third opposed portion so as to extend along an edge of the end.

8. The wireless module according to claim 1, wherein the first antenna has a shape adaptable for a dual band.

9. The wireless module according to claim 1, wherein
the first antenna has a shape adaptable for a dual band,
a first cut is formed in the first opposed portion, and
an electrical length from the short-circuit point to the first cut is approximately ¼ times a shorter resonance wavelength of two resonance wavelengths of the first antenna.

10. The wireless module according to claim 1, wherein
the first antenna has a shape adaptable for a dual band,
a second cut is formed in the second opposed portion, and
an electrical length from an end of the third opposed portion closer to the second opposed portion to the second cut is approximately ¼ times a shorter resonance wavelength of two resonance wavelengths of the first antenna.

11. The wireless module according to claim 1, wherein the first antenna is a planar inverted-F antenna (PIFA).

12. The wireless module according to claim 1, further comprising a dielectric disposed between the substrate and the base plate.

13. An image display device comprising:
the wireless module according to claim 1;
a chassis to which the wireless module is attached; and
a display unit that displays an image,
wherein the base plate is disposed between the substrate and the chassis.

14. A wireless module comprising:
a substrate;
a first ground pattern disposed on a first main surface of the substrate and a second ground pattern disposed on a second main surface of the substrate, the first and second ground patterns being electrically connected to each other, the first ground pattern having a first exposed portion and the second ground pattern having a second exposed portion;
a first antenna disposed between one end of the substrate and the first ground pattern, the first antenna including a grounding part and a first power feeding part, the grounding part being connected to the first ground pattern, the first power feeding part being fed with a first signal;
a second antenna disposed between another end of the substrate and the first ground pattern, the second antenna including a second power feeding part fed with a second signal; and a base plate that is conductive, the base plate including a first opposed portion that faces the first antenna, a second opposed portion that faces the second antenna, and a third opposed portion that faces the second ground pattern and is short-circuited to the first and second ground patterns, wherein the base plate has, on the third opposed portion, a short-circuit point at which the base plate and the first and second ground patterns are short-circuited to each other via the first exposed portion and the second exposed portion, the short-circuit point is disposed at a position nearer to the first opposed portion than to the second opposed portion.

15. The wireless module according to claim 14, wherein the base plate is short-circuited to the second ground pattern by directly connecting the short-circuit point and the second exposed portion on the second main surface to each other.

16. The wireless module according to claim 15, further comprising a fastening member that is conductive and fastens the substrate and the base plate to each other, wherein the first exposed portion and the second exposed portion are disposed at positions facing each other on the substrate, the fastening member is disposed on the short-circuit point, and the base plate is short-circuited to the first ground pattern by being short-circuited to the first exposed portion on the first main surface via the fastening member and the short-circuit point.

17. The wireless module according to claim 14, wherein the first ground pattern is covered with resist except for the first exposed portion, and the second ground pattern is covered with resist except for the second exposed portion.

* * * * *